US009396617B2

(12) United States Patent
Kitamura et al.

(10) Patent No.: US 9,396,617 B2
(45) Date of Patent: Jul. 19, 2016

(54) REEL BAND FOR GAMING MACHINE AND GAMING MACHINE

(71) Applicants: Universal Entertainment Corporation, Koto-ku, Tokyo (JP); Aruze Gaming America, Inc., Las Vegas, NV (US)

(72) Inventors: Kenta Kitamura, Tokyo (JP); Motomichi Sato, Tokyo (JP); Susumu Mio, Tokyo (JP)

(73) Assignees: Universal Entertainment Corporation, Tokyo (JP); Aruze Gaming America, Inc., Las Vegas, NV (US)

( * ) Notice: Subject to any disclaimer, the term of this patent is extended or adjusted under 35 U.S.C. 154(b) by 113 days.

(21) Appl. No.: 14/278,943

(22) Filed: May 15, 2014

(65) Prior Publication Data

US 2014/0339768 A1 Nov. 20, 2014

(30) Foreign Application Priority Data

May 17, 2013 (JP) ..... 2013105308

(51) Int. Cl.
*G07F 17/34* (2006.01)
*G07F 17/32* (2006.01)

(52) U.S. Cl.
CPC ..... *G07F 17/34* (2013.01); *G07F 17/3213* (2013.01)

(58) Field of Classification Search
CPC ..... G07F 17/34; G07F 17/3213
USPC ..... 273/143 R, 138.2; 463/20
See application file for complete search history.

(56) References Cited

U.S. PATENT DOCUMENTS 5,580,055 A * 12/1996 Hagiwara ..... G07F 17/3211 273/143 R
6,926,606 B2 * 8/2005 Onuki ..... G07F 17/3202 273/143 R
7,159,865 B2 1/2007 Okada
7,316,395 B1 * 1/2008 Kromydas ..... G07F 17/3213 273/143 R

* cited by examiner

*Primary Examiner* — Benjamin Layno
(74) *Attorney, Agent, or Firm* — KMF Patent Services, PLLC; S. Peter Konzel; Kenneth M. Fagin

(57) ABSTRACT

To provide a reel device for a gaming machine capable of increasing a reel illumination effect by varying illumination onto the reel. A reel band which is attached to a rotatable reel of a gaming machine includes a base sheet, a light reflecting sheet which has a reflecting surface reflecting light from a front surface side and is superimposed on the base sheet, and a light diffusing sheet which has a light refracting surface, which transmits light and refracts light to be transmitted in multiple directions, and is superimposed on the light reflecting sheet.

18 Claims, 15 Drawing Sheets

REEL BAND FOR GAMING MACHINE AND GAMING MACHINE

BACKGROUND OF THE INVENTION

1. Technical Field

The present invention relates to a reel device including rotatable rotating reels of a gaming machine, and specifically, to a reel band which is used in a reel device including reels to be illuminated by a front light and a gaming machine using the reel band.

2. Related Art

In the related art, a gaming machine employs video reels or mechanical reels so as to display symbols. The video reels are realized by scroll-displaying images of symbols on a display device, such as a liquid crystal display. In the video reels, various images including images of symbols are displayed on the display device, and visibility of symbols is determined by luminance of the display device. In the display device, brightness of a light source, such as luminance on a display surface, is adjusted in advance so as to be nearly constant. If a plurality of pieces of image data which are different in tone, color strength, or color brightness are prepared, display is performed such that image data is gradually switched and displayed to change brightness of images.

In a gaming machine which employs mechanical reels, light-transmitting reel bands with symbols printed thereon are attached to the outer circumference of rotating reels, and the rotating reels are mechanically rotated by a motor or the like, thereby realizing scroll-display of symbols. In case of the mechanical reels, the rotating reels are provided in the housing of the gaming machine. For this reason, in order to allow a player to easily visually recognize the symbols, it is necessary to provide a backlight inside the rotating reel. Light emitted from the backlight is irradiated onto the rear surface of the reel, and light is transmitted through the reel band to improve visibility of the symbols.

As a light source of the backlight of the mechanical reel, a lamp, such as an LED (light-emitting diode), is employed. In particular, an LED is advantageously used in terms of emission intensity, power saving, heat generation prevention, and the like. In recent years, the LED can emit light of a plurality of colors, light having various emission intensities, light having high directivity in an emission range, or the like.

The backlight of the gaming machine is used so as to report the result of a lottery process to the player, or is used so as to show the result of a game determined by a combination of rearranged symbols. In this way, the backlight plays a major role in providing information relating to the game to the player. For this reason, in the gaming machine employing the mechanical reels, various kinds of information are reported to the player using various emission aspects of the backlight having an LED.

However, the backlight is disposed at a given position inside the rotating reel, and light emitted from the backlight travels in a given direction. For this reason, light emitted from the backlight illuminates only a given region of the rear surface of the rotating reel. Most of emitted light is often blocked by the reel band depending on the configuration of the reel band.

In this way, since there is a problem in that the reel cannot be sufficiently illuminated only with the backlight, a gaming machine which uses a front light together has been suggested (for example, Patent Document 1). The front light functions as a backlight of a liquid crystal panel and also functions as a light which irradiates symbols of a rotating reel. The front light is provided in the end portion of the liquid crystal panel, that is, the end portion of a display window of the rotating reel. For this reason, light emitted from the front light cannot reach throughout the front portion of the rotating reel and cannot sufficiently illuminate the front portion of the rotating reel. Accordingly, the front light is merely an auxiliary illumination device, and a backlight for illumination from the rear surface of the rotating reel is also required.

[Patent Document 1] U.S. Pat. No. 7,159,865

SUMMARY OF THE INVENTION

As described above, in the device of the related art, even when a front light is provided, the rotating reel is not sufficiently illuminated only with the front light, and a backlight is required. For this reason, the configuration becomes complicated, and power consumption by the backlight and the front light inevitably increases.

If a backlight becomes essential, since a portion of the reel band where a symbol is printed should have a light transmission property, there is a problem in that the degree of freedom to select a material of the reel band decreases.

The invention has been accomplished in consideration of the above-described point, and an object of the invention is to provide a reel device for a gaming machine capable of sufficiently illuminating a reel with a front light and a gaming machine using the reel device.

A reel band according to an embodiment of the invention comprises a base sheet, a light reflecting sheet having a reflecting surface for reflecting light from a front surface side, the light reflecting sheet being superimposed on the base sheet, and a light diffusing sheet having a light refracting surface, the light refracting surface being for transmitting light and for refracting the light transmitted in multiple directions, and the light diffusing sheet superimposed on the light reflecting sheet, wherein the reel band is configured to be attached to a rotatable reel of a gaming machine.

Light from the front surface side of the reel band first reaches the light diffusing sheet and is refracted in multiple directions when transmitted through the light diffusing sheet. Of refracted light, light which reaches the light reflecting sheet is reflected, reaches the light diffusing sheet again, and is refracted in multiple directions when transmitted through the light diffusing sheet. In this way, the light diffusing sheet is superimposed on the light reflecting sheet, and light is reflected by the light reflecting sheet, whereby light can be transmitted through the light diffusing sheet multiple times. Since light is refracted in multiple directions each time light is transmitted through the light diffusing sheet, light is gradually diffused and spreads in a wide range. Since light can spread in a wide range, the reel band can be illuminated brightly only with light from the front surface side. A backlight is not required, and the configuration can be simplified. Since the reel band can be illuminated only with light from the front surface side, it is also possible to increase the degree of freedom to select a material of the reel band.

In the reel band according to the embodiment of the invention, in addition to above, each of the light reflecting sheet and the light diffusing sheet has an opening passing therethrough at a location where a symbol is to be arranged, and the base sheet has a light transmission property, and is configured to transmit light from a rear surface side and allow the light to be emitted through the opening.

Light from the rear surface side of the reel band is transmitted through the opening, whereby the symbol can be illuminated. Light from the rear surface side is transmitted through the base sheet, is emitted through the opening of the reel band, and travels toward the front side (player) of the gaming machine. Light from the front surface side is reflected by the light reflecting sheet and travels toward the front side (player) of the gaming machine. In this way, light from the rear surface side and light from the front surface side travel by the reel band so as to be visually recognized by the player. Accordingly, it is possible to illuminate the reel band with illumination from the rear surface side as well as illumination from the front surface side of the reel band, and to further enhance a reel illumination effect.

A gaming machine according to another embodiment of the invention comprises a reel assembly having rotatable reels and a front light illuminating the reels from outside, wherein each of the reels has a reel band, the real band including, a base sheet, a light reflecting sheet having a reflecting surface for reflecting light emitted from the front light, and the light reflecting sheet being superimposed on the base sheet, and a light diffusing sheet having a light refracting surface, the light refracting surface being for transmitting light and for refracting the light transmitted in multiple directions, and the light diffusing sheet superimposed on the light reflecting sheet.

Light emitted from the front light first reaches the light diffusing sheet and is refracted in multiple directions when transmitted through the light diffusing sheet. Of refracted light, light which reaches the light reflecting sheet is reflected, reaches the light diffusing sheet again, and is refracted in multiple directions when transmitted through the light diffusing sheet. In this way, the light diffusing sheet is superimposed on the light reflecting sheet, and light is reflected by the light reflecting sheet, whereby light can be transmitted through the light diffusing sheet multiple times. Since light is refracted in multiple directions each time light is transmitted through the light diffusing sheet, light is gradually diffused to spread in a wide range. Since light can spread in a wide range, the reel band can be illuminated brightly only with light from the front light. A backlight is not required, and the configuration can be simplified. Since the reel band can be illuminated only with light from the front light, it is also possible to increase the degree of freedom to select a material of the reel band.

The gaming machine according to another embodiment of the invention further comprises, in addition to above, a backlight for illuminating the reels from inside, wherein each of the light reflecting sheet and the light diffusing sheet has an opening passing therethrough at a location where a symbol is to be arranged, and the base sheet has a light transmission property, and is configured to transmit light emitted from the backlight and allow the light to be emitted through the opening.

Light emitted from the backlight is transmitted through the opening, whereby the symbol can be illuminated. Light emitted from the backlight is transmitted through the opening of the reel band and travels toward the front side (player) of the gaming machine. Light from the front light is reflected by the light reflecting sheet and travels toward the front side (player) of the gaming machine. In this way, light from the backlight and light from the front light travel by the reel band so as to be visually recognized by the player. Accordingly, it is possible to illuminate the reel band with illumination from the backlight as well as illumination from the front light, and to further enhance the reel illumination effect.

It is possible to enhance the reel illumination effect by varying illumination onto the reel.

Figure 1:
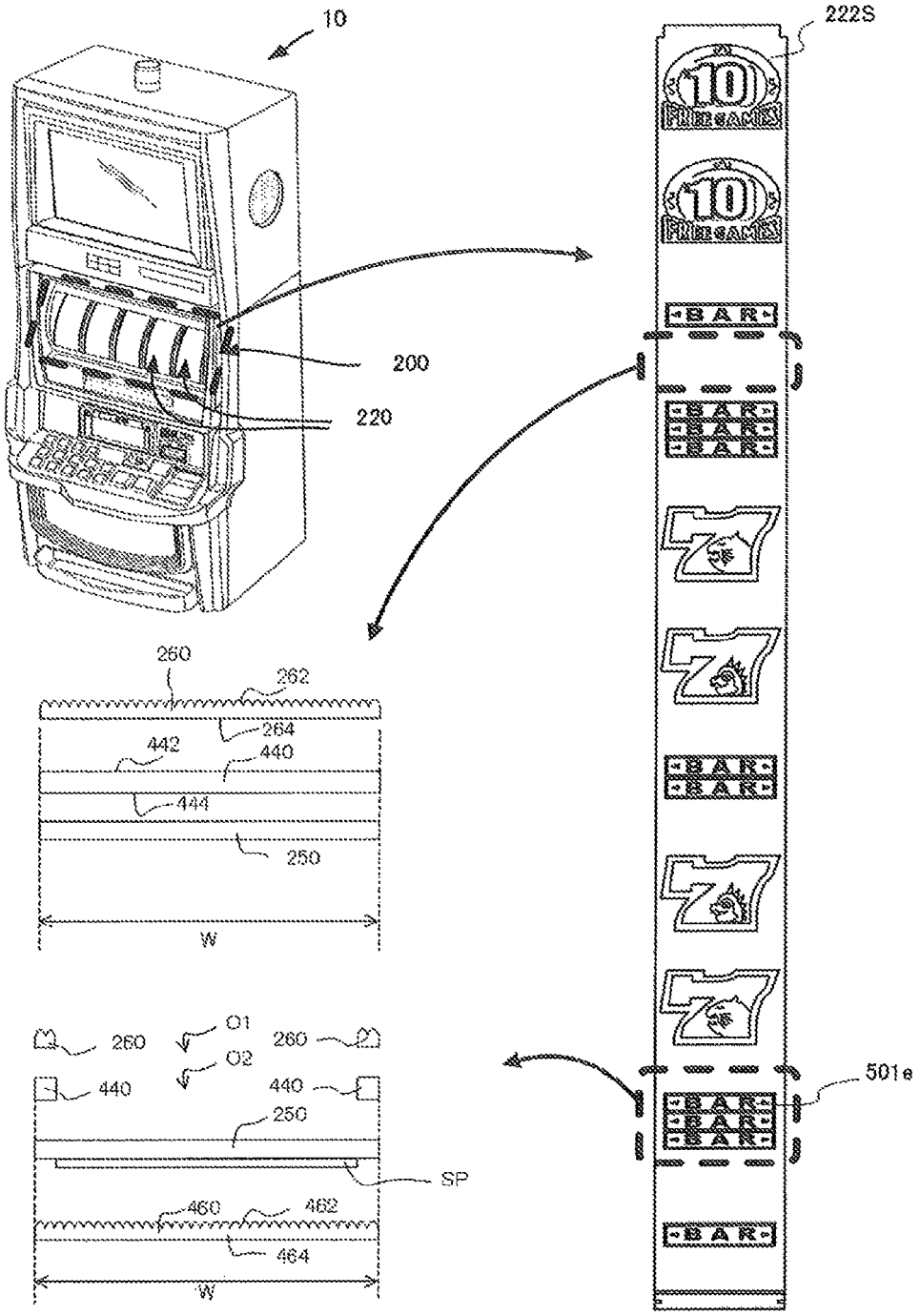
FIG. 1 is a diagram showing the outline of a reel band according to this embodiment.

This application is based on the Patent Applications No. 2013-105308 filed on May 17, 2013 in Japan, the contents of which are hereby incorporated in its entirety by reference into the present application, as part thereof.

The present invention will become more fully understood from the detailed description given hereinbelow. Further range of application of the present invention will become more clear from the detailed description given hereinbelow. However, the detailed description and the specific embodiment are illustrated of desired embodiments of the present invention and are described only for the purpose of explanation. Various changes and modifications will be apparent to those ordinary skilled in the art on the basis of the detailed description.

The applicant has no intention to give to public any disclosed embodiments. Among the disclosed changes and modifications, those which may not literally fall within the scope of the patent claims constitute, therefore, a part of the present invention in the sense of doctrine of equivalents.

DETAILED DESCRIPTION OF THE PREFERRED EMBODIMENT

Hereinafter, an embodiment will be described referring to the drawings.

<<<Outline of Gaming Machine 10>>>

FIG. 1 is a diagram showing the outline of a reel band of a gaming machine 10 according to this embodiment.

A reel band (for example, a reel band 222S described later, or the like) according to this embodiment includes a base sheet (for example, a symbol display sheet 250 described later), a light reflecting sheet (for example, a reflecting sheet 440 described later) which has a reflecting surface (for example, a first surface 442 described later) reflecting light from a front surface side and is superimposed on the base sheet, and a light diffusing sheet (for example, a light diffusing sheet 260 described later) which has a light refracting surface (for example, a first surface 262 described later) transmitting light and refracting light to be transmitted in multiple directions and is superimposed on the light reflecting sheet, wherein the reel band is attached to a rotatable reel of a gaming machine.

The reel band according to this embodiment is attached to the rotatable reel of the gaming machine. The reel band according to this embodiment includes the base sheet, the light reflecting sheet, and the light diffusing sheet.

The light reflecting sheet has the reflecting surface which reflects light from the front surface side. The front surface side is the front surface side of the reel and is the outside of the reel. The light reflecting sheet is superimposed on the base sheet.

The light diffusing sheet has the light refracting surface. The light refracting surface is a surface which transmits light. The light refracting surface is a surface which refracts light to be transmitted in multiple directions. The light diffusing sheet is superimposed on the light reflecting sheet.

Light from the front surface side first reaches the light diffusing sheet. Thereafter, light is refracted in multiple directions by the light diffusing sheet when transmitted through the light diffusing sheet. Of refracted light, part of light reaches the light reflecting sheet. Light which reaches the light reflecting sheet is reflected and reaches the light diffusing sheet again. Light is further refracted in multiple directions by the light diffusing sheet when transmitted through the light diffusing sheet. In this way, the light diffusing sheet is superimposed on the light reflecting sheet, and light is reflected by the light reflecting sheet, whereby light can be transmitted through the light diffusing sheet multiple times. Light is refracted in multiple directions each time light is transmitted through the light diffusing sheet and light is gradually diffused to spread in a wide range, whereby it is possible to enhance the reel illumination effect.

In the reel band according to this embodiment, in addition to above, each of the light reflecting sheet and the light diffusing sheet has an opening (for example, opening O1, O2, or the like described later) which passes therethrough at a location where a symbol is to be arranged, and the base sheet has a light transmission property, transmits light from a rear surface side, and allows light to be emitted through the opening.

The openings are formed in both the light reflecting sheet and the light diffusing sheet. Each opening is a through hole which passes through the sheet. A symbol is to be arranged in the opening. A symbol is attached to the base sheet by printing or the like.

The base sheet has a light transmission property. The base sheet transmits light from the rear surface side and allows transmitted light to be emitted through the opening.

Light from the rear surface side of the reel band is incident on the base sheet, whereby a symbol can be illuminated. Light which illuminates a symbol is emitted through the openings formed in both the light reflecting sheet and the light diffusing sheet. In this way, light from the rear surface side is transmitted through the opening of the reel band and travels toward the front side (player) of the gaming machine. Light from the front surface side is reflected by the light reflecting sheet and travels toward the front side (player) of the gaming machine. In this way, light from the rear surface side and light from the front surface side travel by the reel band so as to be visually recognized by the player. Accordingly, it is possible to illuminate the reel band with illumination from the rear surface side as well as illumination from the front surface side of the reel band, and to further enhance the reel illumination effect.

A gaming machine (for example, a gaming machine 10 described later, or the like) according to this embodiment includes a reel assembly (for example, a reel unit 202 described later, or the like) which has rotatable reels (for example, reels 220*a*, 220*b*, 220*c*, 220*d*, and 220*e* described later, or the like) and a front light (for example, a front light device 400 described later, or the like) illuminating the reels from the outside, wherein each of the reels has a reel band (for example, a reel band 222S described later, or the like) including a base sheet (for example, a symbol display sheet 250 described later), a light reflecting sheet (for example, a reflecting sheet 440 described later) which has a reflecting surface (for example, a first surface 442 described later) reflecting light emitted from the front light and is superimposed on the base sheet, and a light diffusing sheet (for example, a light diffusing sheet 260 described later) which has a light refracting surface (for example, a first surface 262 described later) transmitting light and refracting light to be transmitted in multiple directions and is superimposed on the light reflecting sheet.

Light emitted from the front light first reaches the light diffusing sheet. Thereafter, light is refracted in multiple directions by the light diffusing sheet when transmitted through the light diffusing sheet. Of refracted light, part of light reaches the light reflecting sheet. Light which reaches the light reflecting sheet is reflected and reaches the light diffusing sheet again. Light is further refracted in multiple directions by the light diffusing sheet when transmitted through the light diffusing sheet. In this way, the light diffusing sheet is superimposed on the light reflecting sheet and light is reflected by the light reflecting sheet, whereby light can be transmitted through the light diffusing sheet multiple times. Light is refracted in multiple directions each time light is transmitted through the light diffusing sheet, and light is gradually diffused to spread in a wide range. Since light can spread in a wide range, it is possible to illuminate the reel band only with light from the front surface side, and to simplify the configuration.

The gaming machine according to this embodiment further includes, in addition to above, a backlight (for example, a backlight device 300 described later, or the like) which illuminates the reels from the inside, wherein each of the light reflecting sheet and the light diffusing sheet has an opening (for example, opening O1, O2, or the like described later) which passes therethrough at a location where a symbol is to be arranged, and the base sheet has a light transmission property, transmits light emitted from the backlight, and allows light to be emitted through the opening.

Light from the backlight is incident on the base sheet, whereby a symbol can be illuminated. Light which illuminates a symbol is emitted through the openings formed in both the light reflecting sheet and the light diffusing sheet. In this way, light emitted from the backlight is transmitted through the opening and travels toward the front side (player) of the gaming machine. Light from the front light is reflected by the light reflecting sheet and travels toward the front side (player) of the gaming machine. In this way, light from the backlight and light from the front light travel by the reel band so as to be visually recognized by the player. Accordingly, it is possible to illuminate the reel band with illumination from the backlight as well as illumination from the front light, and to further enhance the reel illumination effect.

<<<Overall Configuration of Gaming Machine 10>>>

Figure 2:
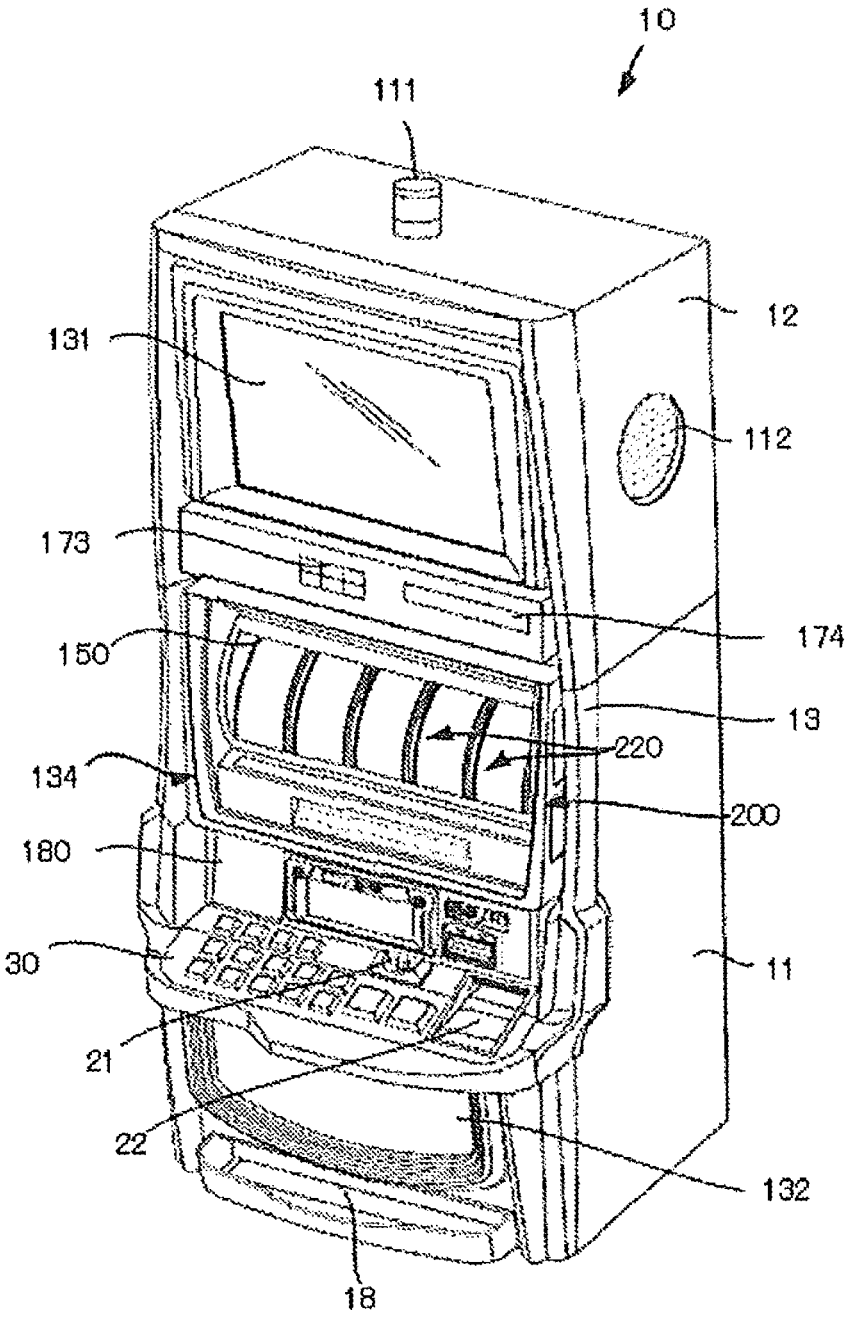
FIG. 2 is a perspective view showing the overall configuration of the gaming machine 10 according to the embodiment of the invention.

FIG. 2 is a perspective view showing the overall configuration of the gaming machine 10 according to the embodiment of the invention.

In the gaming machine 10, as a game medium, a coin, a bill, or corresponding electronic valuable information is used.

The gaming machine 10 includes a cabinet 11, a top box 12 provided at the top of the cabinet 11, and a main door 13 provided on the front surface of the cabinet 11.

The main door 13 is provided with a reel device 200. A reel cover 134 is provided on the front surface of the reel device 200.

As shown in FIG. 2, the reel cover 134 has a display window 150 in a central portion. The display window 150 allows 15 symbols 501 of 5 columns×3 rows to be visually recognized from the outside of the gaming machine 10. The three symbols 501 of each column are a part of a symbol group arranged on the outer circumferential surface of each of the reels 220*a* to 220*e*. The five reels 220*a* to 220*e* are controlled to be rotated, whereby the symbols 501 arranged on each of the reels 220*a* to 220*e* can be displayed to move downward or upward while changing the speed overall. The five reels 220*a* to 220*e* are controlled to be stopped, whereby the symbols 501 are stopped to rearrange the 15 symbols 501 of 5 columns×3 rows in the display window 150.

In this embodiment, although a case where the gaming machine 10 includes the mechanical reel-type reel device 200 is described, the gaming machine 10 of the invention may mixedly include a video reel type, which displays pseudo reels, and a mechanical reel type. The reel cover 134 may be provided with a touch panel. In this case, a player can operate the touch panel to input various instructions. An input signal is transmitted from the touch panel to a main CPU (not shown). The reel cover 134 may have a transparent liquid crystal panel or a transparent panel.

A control panel 30 is disposed below the reel device 200. The control panel 30 includes various buttons, a coin entry 21 which receives coins into the cabinet 11, and a bill entry 22.

A control panel 30 has a "RESERVE" button, a "COLLECT" button, a "GAME RULES" button, a "1-BET" button, a "2-BET" button, a "3-BET" button, a "5-BET" button, and a "10-BET" button. A "RESERVE" button, a "COLLECT" button, and a "GAME RULES" button are disposed in an upper left region of the control panel 30. A "1-BET" button, a "2-BET" button, a "3-BET" button, a "5-BET" button, and a "10-BET" button are disposed in the lower left region of the control panel 30. A "START" button is disposed in the lower central region of the control panel 30.

The "RESERVE" button is used when the player temporarily leaves the seat or when the player wants to ask a staff of the game facility to exchange money. The "RESERVE" button can also be used to store remaining credits in the IC card inserted into the IC card reader. The "COLLECT" button is used to instruct the slot machine 10 to pay out credited coins to a coin tray. The "GAME RULES" button is used when the player is not acquainted with game rules or operation methods. If the "GAME RULES" button is pressed, various types of help information are displayed on an upper image display panel 131.

The "BET" buttons are used to set the amount of bet. Each time the "1-BET" button is pressed, one credit among the current credits owned by the player is bet for each active pay line. If the "2-BET" button is pressed, the unit game starts under a condition that two credits are bet for each active pay line. If the "3-BET" button is pressed, the unit game starts under a condition that three credits are bet for each active pay line. If the "5-BET" button is pressed, the unit game starts under a condition that five credits are bet for each active pay line. If the "10-BET" button is pressed, the unit game starts under a condition that ten credits are bet for each active pay line. The SPIN button (START button) is used to instruct the start of rotation of the reels 220*a* to 220*e* under the bet condition previously set.

As shown in FIG. 2, on the lower front surface of the main door 13, that is, below the control panel 30, a coin reception slot 18 for receiving coins and a belly glass 132 on which the character of the gaming machine 10 or the like is drawn are provided.

On the front surface of the top box 12, an upper image display panel 131 is provided. The upper image display panel 131 has a liquid crystal panel and configures a display. The upper image display panel 131 displays images related to effects or images representing description of contents and rules of a game. The top box 12 is provided with a lamp 111 and a speaker 112. In the gaming machine 10, effects are executed by image display, sound output, and light output.

Below the upper image display panel 131, a data display 174 and a keypad 173 are provided. The data display 174 has a fluorescent display, an LED, or the like, and displays member data read from an IC card inserted from a PTS terminal 180 or data input through the keypad 173 by the player. The keypad 173 is used to input data.

<<Reel Device 200>>

Figure 3:
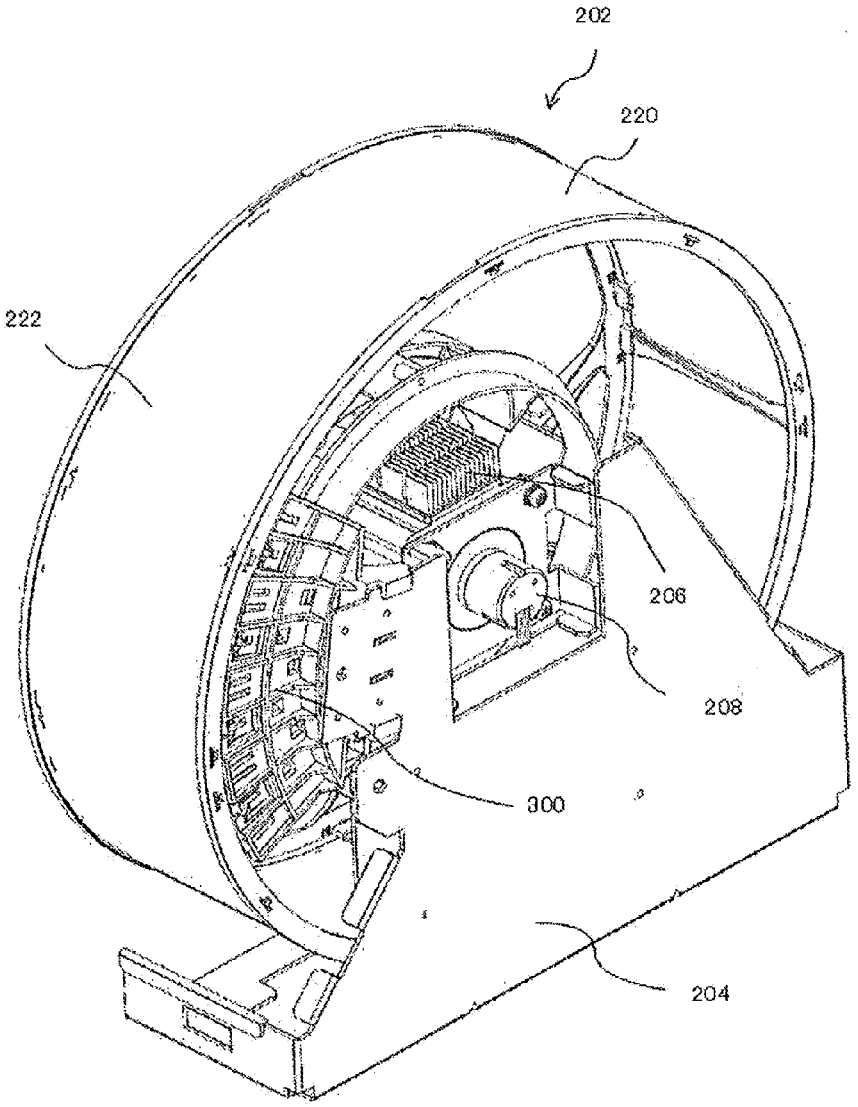
FIG. 3 is a perspective view showing the reel unit 202.

FIG. 3 is a perspective view showing the reel unit 202.

The reel device 200 (see FIG. 2) in the gaming machine 10 supports the five reels 220*a* to 220*e* in a horizontal direction such that the rotating axes of the five reels 220*a* to 220*e* are on the same straight line. In the reel device 200, five reel units 202*a* to 202*e* are detachably held. The symbols 501 are arranged on the outer circumferential surface of each of the five reels 220*a* to 220*e*. In this embodiment, as the symbols 501, as described later, there are six symbols 501*c*, 501*d*, 501*e*, 501*g*, 501*h*, and 501*i*.

The reel unit 202*a* has the reel 220*a*, and a reel support mechanism 204*a* which supports the reel 220*a*. The reel unit 202*a* drives and rotates the reel 220*a*. The reel 220*a* has an annular reel band 222*a* on which one or more symbols 501 are arranged.

The reel unit 202*b* has the reel 220*b*, and a reel support mechanism 204*b* which supports the reel 220*b*. The reel unit 202*b* drives and rotates the reel 220*b*. The reel 220*b* has an annular reel band 222*b* on which one or more symbols 501 are arranged.

The reel unit 202*c* has the reel 220*c*, and a reel support mechanism 204*c* which supports the reel 220*c*. The reel unit 202*c* drives and rotates the reel 220*c*. The reel 220*c* has an annular reel band 222*c* on which one or more symbols 501 are arranged.

The reel unit 202*d* has the reel 220*d*, and a reel support mechanism 204*d* which supports the reel 220*d*. The reel unit 202*d* drives and rotates the reel 220*d*. The reel 220*d* has an annular reel band 222*d* on which one or more symbols 501 are arranged.

The reel unit 202*e* has the reel 220*e*, and a reel support mechanism 204*e* which supports the reel 220*e*. The reel unit 202*e* drives and rotates the reel 220*e*. The reel 220*e* has an annular reel band 222*e* on which one or more symbols 501 are arranged.

The reels 220*a* to 220*e* are respectively driven to be rotated by the five reel units 202*a* to 202*e*, whereby the symbols 501 are to be rearranged. That is, the 15 symbols 501 of 5 columns×3 rows are arranged in the display window 150, whereby the symbols 501 are rearranged in the display window 150. Accordingly, it is possible to allow the player to visually recognize the symbols 501 rearranged in the display window 150.

In the following description, when there is no need for distinction between the five reel units 202*a* to 202*e*, the reel units 202*a* to 202*e* are simply referred to as the reel units 202. Similarly, when there is no need for distinction between the five reels 220*a* to 220*e*, the reels 220*a* to 220*e* are simply referred to as the reels 220.

Each of the reel units 202 has a reel driving mechanism 206 which drives and rotates the reel 220 to rearrange the symbols 501, and a reel angle detection mechanism 208 which outputs a position pulse signal in units of a predetermined angle with the rotation of the reel 220 and outputs an origin pulse signal for each rotation of the reel 220.

<<Reel 220>>

Figure 4:
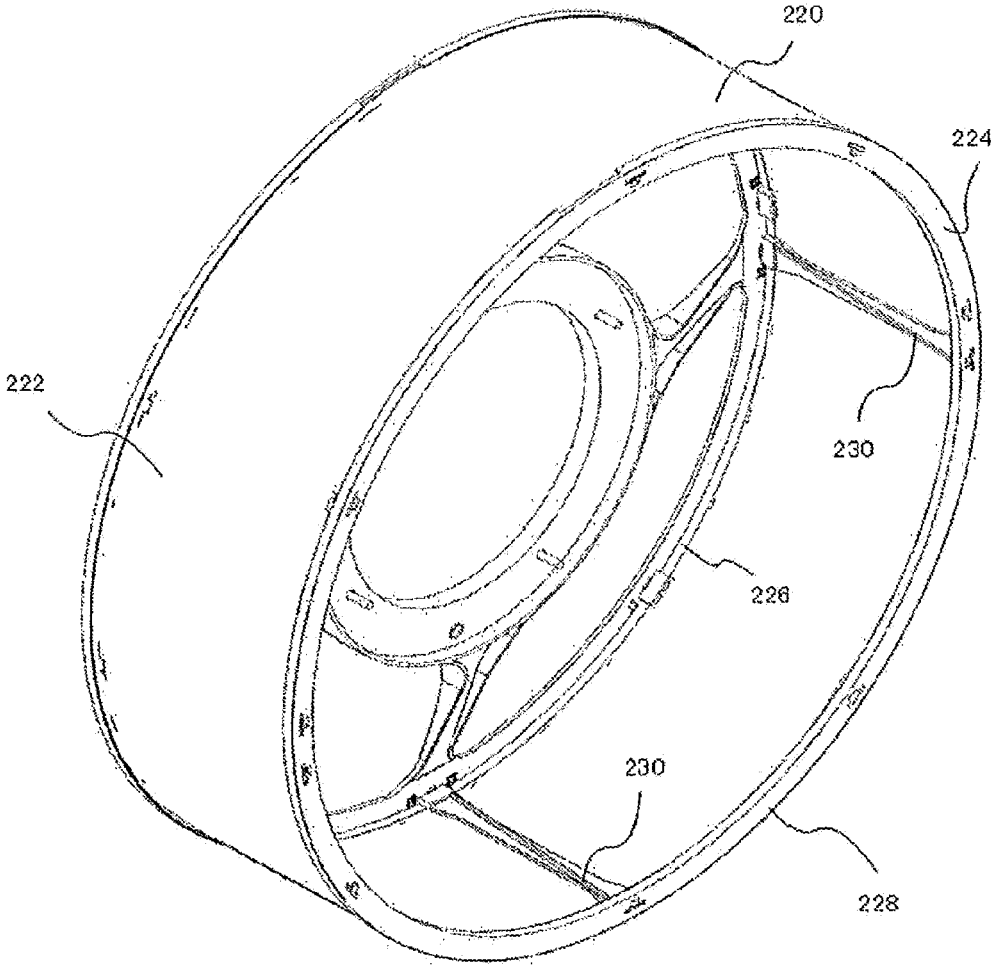
FIG. 4 is a perspective view showing the reel 220.

FIG. 4 is a perspective view showing the reel 220.

The reel 220 has a reel band 222 and a reel frame body 224. The reel band 222 has an annular shape. On the reel band 222, one or more symbols 501 are arranged in a circumferential direction. The reel frame body 224 is provided with the reel band 222 on the outer circumferential surface thereof.

The reel frame body 224 has a driving reel frame body 226 which holds one edge of the reel band 222, a driven reel frame body 228 which holds the other edge of the reel band 222, and frame body connecting members 230 which connect the outer circumferential portions of the driving reel frame body 226 and the driven reel frame body 228. The reel frame body 224 having these members is formed of a material which transmits light.

In the reel 220, since the reel frame body 224 is assembled by connecting the driving reel frame body 226 and the driven reel frame body 228 through the frame body connecting members 230 from a state in which the reel frame body 224 is separated into the driving reel frame body 226 and the driven reel frame body 228, it is possible to easily change the width of the reel frame body 224, that is, the width of the reel 220 including the reel frame body 224 and the reel band 222 only by changing the length of the frame body connecting members 230.

The driven reel frame body 228 has a reel band fitting portion into which the edge of the reel band 222 is fitted. The reel band fitting portion of the driven reel frame body 228 is formed along the whole circumference of the driven reel frame body 228. Similarly, the driven reel frame body 226 has a reel band fitting portion into which the edge of the reel band 222 is fitted. The reel band fitting portion of the driven reel frame body 226 is formed along the whole circumference of the driven reel frame body 228.

One edge (left edge) of the reel band 222 can be put in the reel band fitting portion of the driving reel frame body 226 along the whole circumference of the driving reel frame body 226. The other edge (right edge) of the reel band 222 can be put in the reel band fitting portion of the driven reel frame body 228 along the whole circumference of the driven reel frame body 228. The driving reel frame body 226 and the driven reel frame body 228 are connected through the frame body connecting members 230, whereby the reel 220 can be assembled across one edge and the other edge of the reel band 222. With this, it becomes possible to simply attach the reel band 222 to the reel frame body 224. The reel frame body 224 holds the whole circumference of the reel band 222, whereby it is possible to enhance the shape holding property when the reel band 222 is held by the reel frame body 224.

The frame body connecting members 230 are disposed to support the rear surface of the reel band 222. Accordingly, it is possible to further enhance the shape holding property when held by the reel frame body 224. The reel band 222 is formed of a material, such as acrylic resin, which can transmit illumination light.

The configuration of the reel band 222 according to this embodiment will be further described later.

<<Backlight Device 300>>

A backlight device 300 is provided on the inner circumference side of each of the reels 220*a* to 220*e*. The backlight device 300 emits irradiation light from the inside of each of the reels 220*a* to 220*e* toward the reel band 222. Irradiation light illuminates the symbols of the reel band 222 from the rear surface of the reel band 222. The symbols 501 are visually recognized by the player from the outside of the gaming machine 10.

Figure 5:
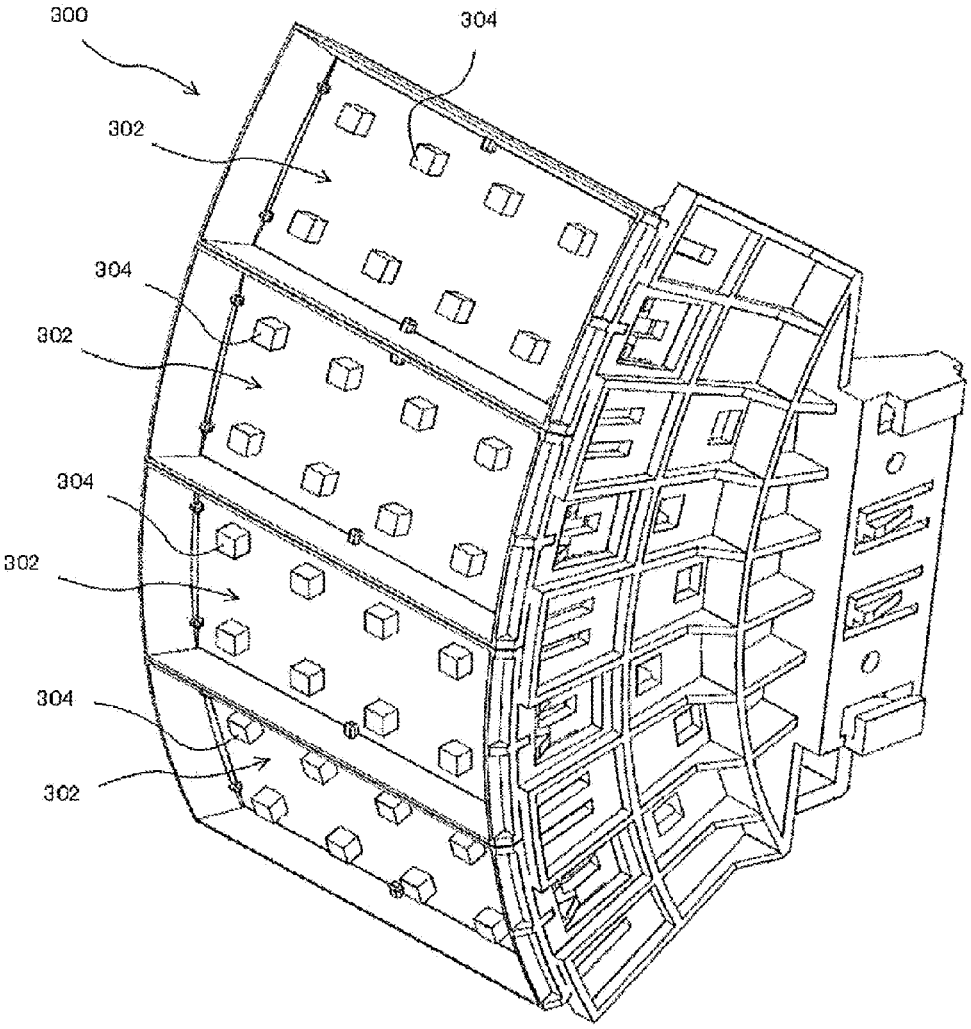
FIG. 5 is a perspective view showing the backlight device 300.

The backlight device 300 is provided corresponding to each of the five reels 220*a* to 220*e*. As shown in FIG. 5, the backlight device 300 has four modules 302 which are formed into a unit. In each of the modules 302, eight light source devices 304 are disposed in a matrix.

Each of the light source devices 304 is, for example, a full-color LED in which a red LED element capable of emitting red light, a blue LED element capable of emitting blue light, and a green LED element capable of emitting green light are packaged. In each light source device 304, turn-on and turn-off of the red LED element, the blue LED element, and the green LED element are controlled by the main CPU (not shown) or the amount of light emission upon turn-on is controlled by the main CPU (not shown) for each LED element. The light source device 304 can emit visible light of an arbitrary color with desired intensity by adjusting the amount of light of each LED element.

<<Front Light Device 400>>

As shown in FIG. 2, the main door 13 is provided with the reel device 200. The reel cover 134 is provided on the front surface of the reel device 200. The reel band 222S is illuminated by a light source device 404 of a front light device 400 as well as the light source device 304 of the backlight device 300.

Figure 6:
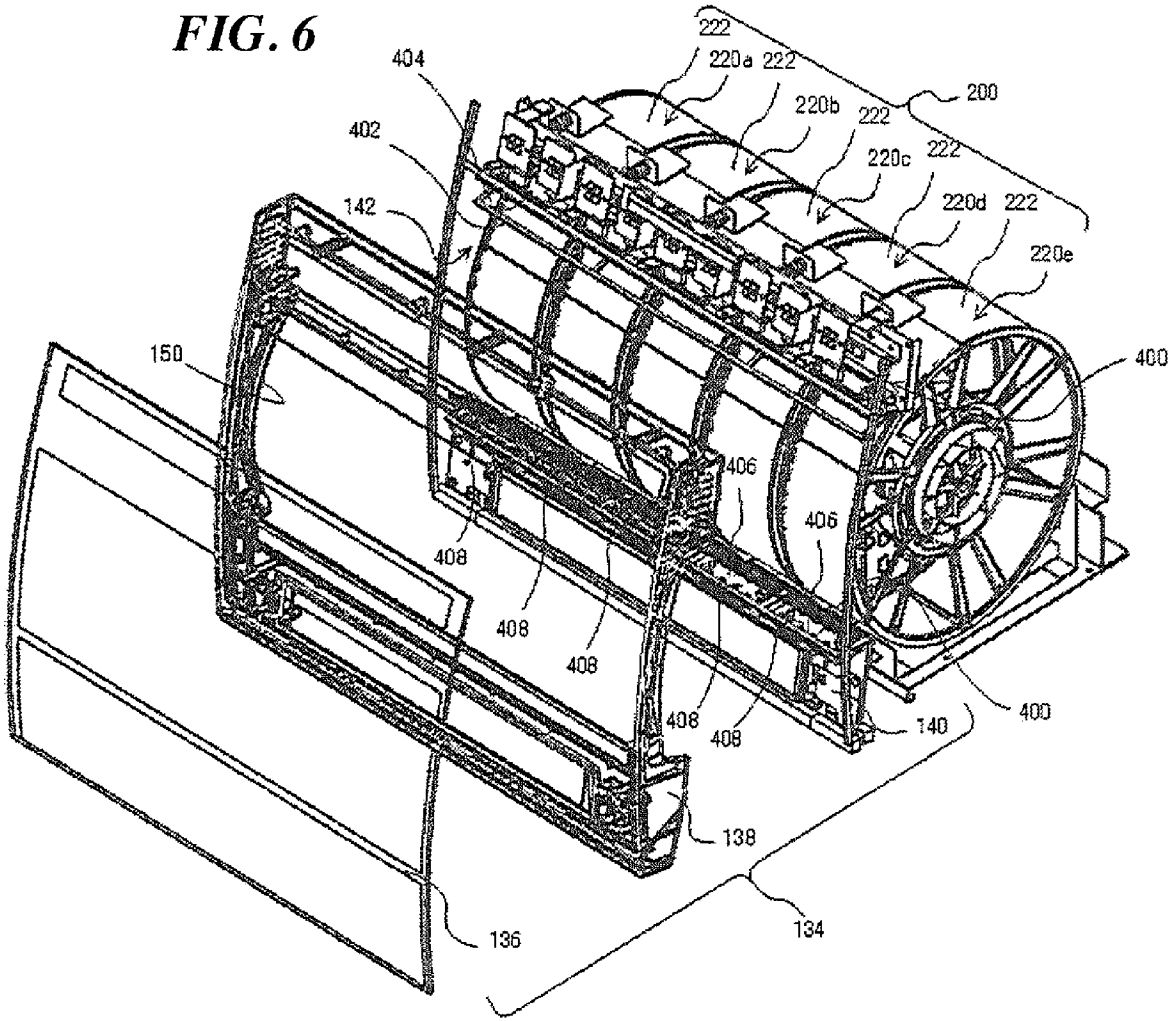
FIG. 6 is an exploded perspective view of a reel device and a reel cover.
Figure 7:
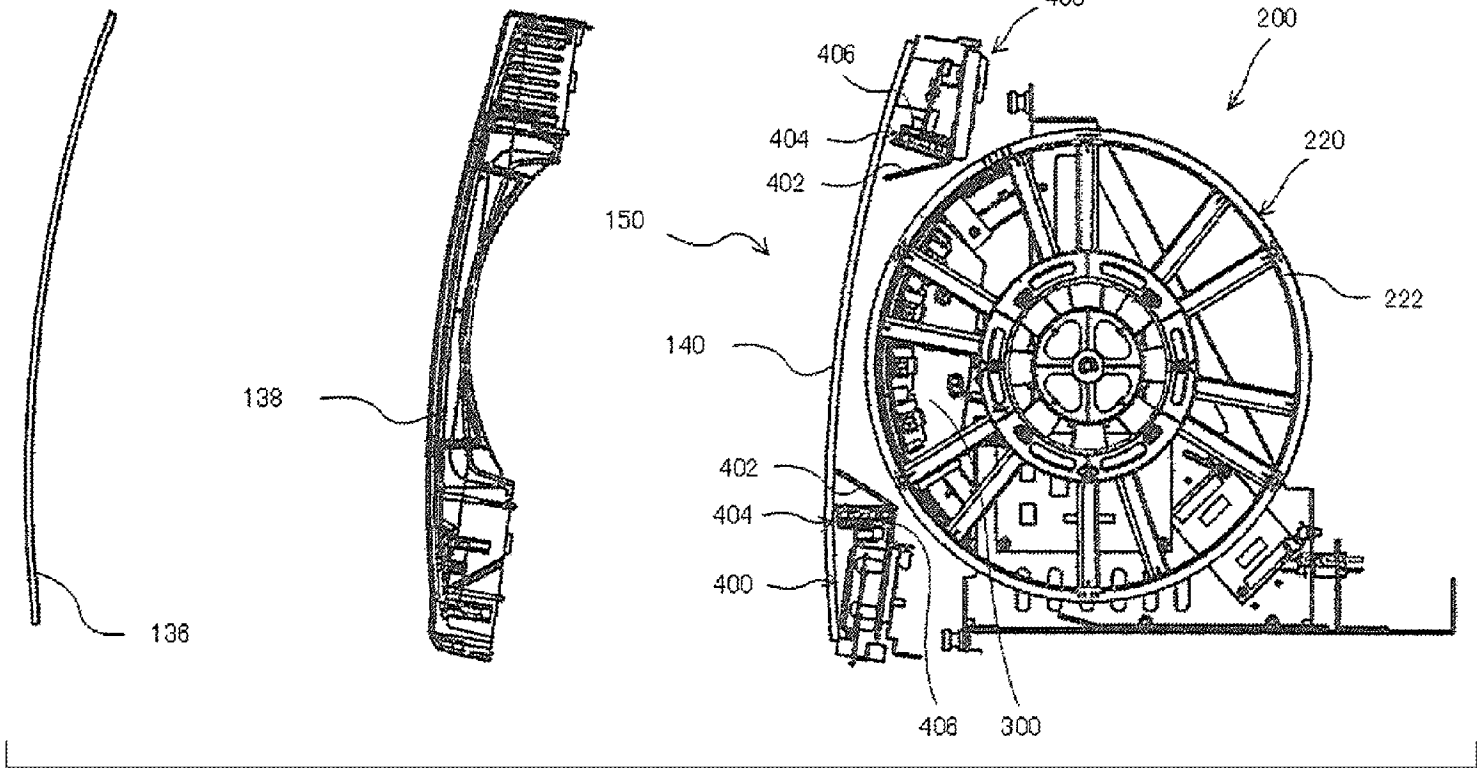
FIG. 7 is an exploded configuration diagram of a reel device and a reel cover.

FIG. 6 is an exploded perspective view of a reel device and a reel cover. FIG. 7 is an exploded configuration diagram of a reel device and a reel cover. As shown in FIG. 6 and FIG. 7, the reel cover 134 has a transparent panel 136, a panel frame 138, and a panel support 140. The transparent panel 136 is provided on the front surface of the panel frame 138. The panel support 140 supports the panel frame 138.

The panel support 140 is provided with a front light device 400. The front light device 400 has a light transmitting panel 402 and a light source device 404. The light transmitting panel 402 is made of a light transmitting member and is provided in an opening 142 of the panel support 140. The light source device 404 emits light having a predetermined wavelength, for example, visible light.

The light transmitting panel 402 transmits visible light. Visible information of a predetermined color, for example, character information, a pattern, or the like may be formed on the light transmitting panel 402. The light transmitting panel 402 substantially has the same width as the width of the reel device 200. The light source device 404 is formed so as to emit visible light over the whole width of the light transmitting panel 402.

Similarly to the light source device 304 of the backlight device 300, the light source device 404 has a plurality of full-color LEDs 406. Each of the full-color LEDs 406 is a single light emitting source using chips of light-emitting diodes of red, green, and blue as the three primary colors of light. The full-color LED 406 can form and emit visible light of an arbitrary color by adjusting the amount of light of the LED of each color.

The full-color LEDs 406 are disposed in a matrix of a width direction and a depth direction. Specifically, the light source device 404 has an LED unit 408 in which two sets of four full-color LEDs 406 disposed in 2 columns and 2 rows are disposed in the width direction of the reel band 222. The LED unit 408 is disposed corresponding to each of the reels 220*a* to 220*e*. Accordingly, the turn-on positions of the full-color LEDs are controlled, making it possible to adjust the irradiation positions onto the reel device 200.

The light source device 404 switchably emits visible light which becomes a complementary color with respect to the coloring of the light transmitting panel 402 and visible light other than the complementary color. Specifically, when the light transmitting panel 402 is colored red, the light source device 404 switchably emits visible light of green as a complementary color of red and visible light of red other than green. Accordingly, the front light device 400 switches visible light of a complementary color and visible light other than the complementary color, making it possible to display or hide visible information on the reels 220*a* to 220*e*.

The light source device 404 in this embodiment can form visible light which becomes a complementary color and visible light other than the complementary color with a single full-color LED. The invention is not limited to the full-color LED, and the light source device 404 may have a monochrome LED which outputs visible light of a complementary color and a monochrome LED which outputs visible light other than the complementary color.

<<Reel Band 222S>>

In this embodiment, as described later, the reel device 200 has a reel band 222S as the reel band 222. The five reel bands 222*a* to 222*e* represent the reel bands which are respectively attached to the reels 220*a* to 220*e* of the reel device 200. The reel band 222S represents a type of reel band on which symbols are arranged in a predetermined arrangement. The reel band 222S is used in at least one reel band of the five reel bands 222*a* to 222*e*.

Figure 8:
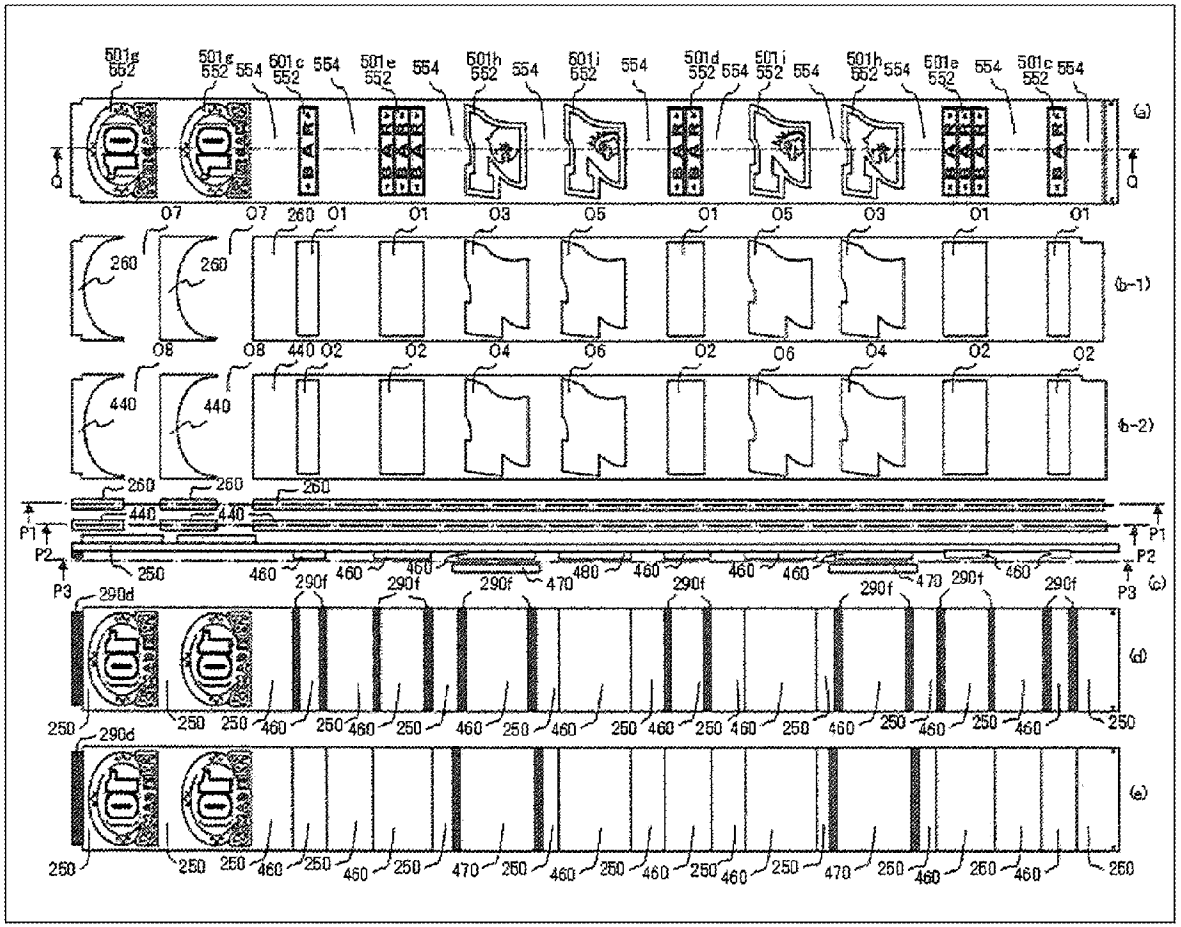
FIG. 8 is a front view (a) showing the front surface of the reel band 222S, longitudinal sectional views (b-1), (b-2), (c), and (d), and a rear view (e).

FIG. 8 is a front view (a) showing the front surface of the reel band 222S, longitudinal sectional views (b-1), (b-2), (c), and (d), and a rear view (e). Specifically, FIG. 8 (a) is a front view showing the front surface of the reel band 222S. FIG. 8 (b-1) is a longitudinal sectional view taken along a P1-P1 section. FIG. 8 (b-2) is a longitudinal sectional view taken along a P2-P2 section. FIG. 8 (*c*) is a longitudinal sectional view taken along a Q-Q section. FIG. 8 (*d*) is a longitudinal sectional view taken along a P3-P3 section. FIG. 8 (*e*) is a rear view showing the rear surface.

<<Symbol 501>>

In this embodiment, a plurality of types of symbols are printed on each reel band 222S.

As shown in FIG. 8 (a), six symbols 501*c*, 501*d*, 501*e*, 501*g*, 501*h*, and 501*i* are printed on the reel band 222S. The symbol 501*c* is a symbol which represents one character "BAR". The symbol 501*d* is a symbol which represents two characters "BAR". The symbol 501*e* is a symbol which represents three characters "BAR".

The symbol 501*g* is a symbol which can display a character "FREE GAMES" and a numerical value "10" or "20". The symbols 501*h* and 501*i* are symbols having an appearance with the shape of the number 7 printed.

Hereinafter, when there is no need for distinction between the six symbols 501*c*, 501*d*, 501*e*, 501*g*, 501*h*, and 501*i*, the symbols 501*c*, 501*d*, 501*e*, 501*g*, 501*h*, and 501*i* are simply referred to as the symbols 501. In this embodiment, as described later, no blank symbol is included in the symbols 501.

<<Configuration of Reel Band 222S>>

As shown in FIGS. 8, 9, 11, 12, 13, and 14, the reel band 222S of this embodiment has a reflecting sheet 440, a light diffusing sheet 260, a front surface sheet 250, a light dimming sheet 450, light refracting sheets 460, 470, 480, and a symbol display sheet 490.

<Front Surface Sheet 250>

The front surface sheet 250 is a sheet which is transparent and flexible, and has an elongated band-like shape. For example, it is preferable that the front surface sheet 250 is made of a PET (polyethylene terephthalate) film.

The symbols 501, patterns, or the like are printed on the rear surface of the front surface sheet 250. For example, the symbols 501 (symbols 501*c*, 501*d*, 501*e*, 501*h*, and 501*i*), patterns, or the like can be printed on the rear surface of the front surface sheet 250 by a UV ink jet method or the like. The symbol 501*g* is printed on the symbol display sheet 490.

As shown in FIGS. 9B, 11B, 12B, 13B, and 14B, the front surface sheet 250 has two ends of a first end 258*a* and a second end 258*b*. The two ends 258*a* and 258*b* are formed along the longitudinal direction of the front surface sheet 250. The two ends 258*a* and 258*b* are formed so as to face each other while being separated from each other. The front surface sheet 250 has a width W along a direction perpendicular to the longitudinal direction. That is, the width W is the length from the first end 258*a* to the second end 258*b* along a direction perpendicular to the longitudinal direction of the front surface sheet 250.

<Light Diffusing Sheet 260>

The light diffusing sheet 260 is a sheet which has a light transmission property, is flexible, and has an elongated band-like shape. The light diffusing sheet 260 is, for example, milky white. Although the light diffusing sheet 260 is non-transparent white, the light diffusing sheet 260 has a light transmission property. The light diffusing sheet 260 has two front surfaces of a first front surface 262 and a second front surface 264.

It is preferable that the light diffusing sheet 260 is made of a soft PVC (polyvinyl chloride) film. As the light diffusing sheet 260, for example, an effect sheet (manufactured by Three Like Co., Ltd.: SPARKLE soft PVC) or the like may be used.

A plurality of minute corrugations having a predetermined shape are formed on the first front surface 262. The corrugations have a plurality of concave portions and a plurality of convex portions. A plurality of concave portions and a plurality of convex portions are formed randomly. A plurality of concave portions and a plurality of convex portions are formed randomly, whereby light incident on the first front surface 262 of the light diffusing sheet 260 can be refracted in all directions and scattered. That is, light incident on the first front surface 262 can be diffused by a plurality of concave portions and a plurality of convex portions formed randomly.

The convex portions and the concave portions may be formed by curved surfaces or may be formed by a combination of planes. The convex portions function as minute convex lenses. The concave portions function as minute concave lenses. It should suffice that the convex portions and the concave portions can function as these lenses to diffuse light incident on the first surface 262.

Specifically, part of light incident on the first front surface 262 is reflected and the remainder of light is refracted by the corrugations formed on the first front surface 262. Reflected light and refracted light by the corrugations spread with distance from the light diffusing sheet 260. In this way, light incident on the light diffusing sheet 260 is diffused by the corrugations.

As a parameter representing the corrugations, for example, there is arithmetic average roughness (Ra) of the corrugations. The corrugations of the light diffusing sheet 260 can be formed such that the arithmetic average roughness (Ra) falls within a predetermined range taking into consideration the wavelength of light to be used or the like. It is possible to determine the degree of diffusion of light incident on the light diffusing sheet 260 by the arithmetic average roughness (Ra). The arithmetic average roughness (Ra) increases, thereby roughening the corrugations and increasing the degree of diffusion of light. The arithmetic average roughness (Ra) decreases, thereby smoothing the corrugations and decreasing the degree of diffusion of light.

As a parameter representing the surface roughness of the corrugations, in addition to the arithmetic average roughness (Ra), ten-point average roughness (Rz), maximum height (Rmax), or the like may be used. Furthermore, other roughness parameters may be used. Any parameter may be used as the degree of diffusion of incident light by the corrugations.

No corrugations are formed on the second front surface 264. The second front surface 264 is finished smoothly compared to the first front surface 262.

The corrugations of the first front surface 262 can be formed in the following manner. For example, fine particles collide against the light diffusing sheet 260 to form fine corrugations in the light diffusing sheet 260 (sandblasting method). The light diffusing sheet 260 is pressed against a mold having corrugations formed in advance, and the corrugations of the mold are transferred to the light diffusing sheet 260 to form corrugations in the light diffusing sheet 260 (embossing method). Furthermore, light transmitting particulates are attached to the light diffusing sheet 260 to form corrugations. In addition, an energy beam, such as laser, is irradiated onto the light diffusing sheet 260 to form corrugations.

As shown in FIGS. 9B, 11B, 12B, 13B, and 14B, the light diffusing sheet 260 has two ends of a first end 269*a* and a second end 269*b*. The two ends 269*a* and 269*b* are formed along the longitudinal direction of the light diffusing sheet 260. The two ends 269*a* and 269*b* are formed so as to face each other while being separated from each other. The light diffusing sheet 260 has a width W along a direction perpendicular to the longitudinal direction. That is, the width W is the length from the first end 269*a* to the second end 269*b* along a direction perpendicular to the longitudinal direction of the light diffusing sheet 260.

In this way, the front surface sheet 250 and the light diffusing sheet 260*b* have the same width W.

<Reflecting Sheet 440>

The reflecting sheet 440 is a sheet for reflecting incident light. The reflecting sheet 440 has an elongated band-like shape, excluding the periphery of the symbol 501*g*. The reflecting sheet 440 has a first front surface 442 and a second front surface 444. The first front surface 442 is finished smoothly, and for example, is finished in a mirror finished shape. The first front surface 442 has a predetermined color, for example, a golden color. The reflecting sheet 440 is disposed such that the first front surface 442 finished smoothly becomes the front-side surface of the reel band 222S. The reflecting sheet 440 reflects light emitted from the light source device 404 of the front light device 400 by the first front surface 442 finished smoothly.

As the reflecting sheet 440, for example, a gold mirror sticker (manufactured by NICHIEI KAKOH CO., LTD.: Copper 50-SN: PET 50 μm) or the like may be used. It should suffice that the reflecting sheet 440 can reflect incident light to a certain extent, and it is not necessary that the surface thereof is finished smoothly. It is preferable that the reflecting sheet 440 has high reflectance and low transmittance. It is more preferable that incident light is totally reflected or nearly reflected, and specifically, 90% or more of incident light is reflected.

<Light Dimming Sheet 450>

The light dimming sheet 450 is a sheet which has a light transmission property, is flexible, and has an elongated band-like shape. The light dimming sheet 450 is a sheet for lowering intensity of light to be transmitted. That is, the light dimming sheet 450 is a sheet whose transmittance has a predetermined value less than 1. The light dimming sheet 450 decreases intensity when light emitted from the light source device 304 of the backlight device 300 is transmitted therethrough. The light dimming sheet 450 is a sheet for the symbol 501*g*, and is a sheet for adjusting intensity of light emitted from the symbol 501*g*. As the light dimming sheet 450, a smoke sheet (manufactured by LUMINIX GLASS FILM INC: Lumina LA20SR DARK Gray tint) or the like may be used.

<Light Refracting Sheets 460, 470, and 480>

The light refracting sheets 460, 470, and 480 are sheets which are non-transparent, but have a light transmission property, are flexible, and have a rectangular shape. The light refracting sheet 460 has a size corresponding to each of the symbols 501*c*, 501*d*, 501*e*, and 501*h*, and has a size enough to cover the whole of each symbol. The light refracting sheet 470 has a size enough to cover the whole of the symbol 501*h*. The light refracting sheet 480 has a size enough to cover the whole of the symbol 501*i*. In this way, the light refracting sheets 460, 470, and 480 are sheets for individually decorating the symbols 501*c*, 501*d*, 501*e*, and 501*h* and the symbol 501*i* by refraction of light.

The light refracting sheet 460 has two front surfaces of a first front surface 462 and a second front surface 464. The light refracting sheet 470 has two front surfaces of a first front surface 472 and a second front surface 474. The light refracting sheet 480 has two front surfaces of a first front surface 482 and a second front surface 484. For example, it is preferable that the light refracting sheets 460, 470, and 480 are made of a soft PVC (polyvinyl chloride) film. As the light refracting sheets 460, 470, and 480, for example, an effect sheet (manufactured by Three Like Co., Ltd.: PLANE soft PVC or manufactured by Three Like Co., Ltd.: SPARKLE soft PVC) or the like may be used.

Minute corrugations having a predetermined shape are formed in each of the first front surfaces 462, 472, and 482. In each of the first front surfaces 462, 472, and 482, the shape of regular corrugations are formed by a plurality of protrusions, grooves, ridges, or the like. For example, the corrugations may have a shape in which convex portions are formed in a lattice shape or a shape in which concave portions are formed in a lattice shape. The lattice may be a square or rectangular sail or may have a rhombic shape or a parallelogram shape. The corrugations are formed in a lattice shape, whereby a plurality of minute elongated convex portions or concave portions are arranged regularly in the first front surfaces 462, 472, and 482. The corrugations in the first front surfaces 462, 472, and 482 may have a regular shape, as well as the lattice shape.

The respective convex portions and concave portions forming the corrugations function as lenses, such as a cylindrical lens, or function as prisms. In this way, the corrugations are formed regularly, whereby the corrugations can function such that a plurality of minute elongated lenses or a plurality of minute elongated prisms are arranged regularly. Accordingly, light incident on the light refracting sheets 460, 470, and 480 can be reflected or refracted in a predetermined direction based on the corrugations by the lenses or prisms arranged regularly.

The light refracting sheets 460, 470, and 480 are different in regularity of the corrugations. For example, the interval or height (depth) of the convex portions or concave portions, the length in the longitudinal direction, the direction in the longitudinal direction of the convex portions or the concave portions, or the like differs from each other, whereby regularity can be changed. With this, the direction in which light incident on the light refracting sheets 460, 470, and 480 is reflected or refracted, or the intensity of light can differ from each other. With this, it is possible to enhance effects by light emitted from the backlight device 300.

The light refracting sheet 460 is superimposed on the symbols 501*c*, 501*d*, 501*e*, and 501*h*. It is possible to enhance effects by light which illuminates the symbols 501*c*, 501*d*, 501*e*, and 501*h*. The light refracting sheet 470 is superimposed on the symbol 501*h*. It is possible to enhance effects by light which illuminates the symbol 501*h*. The light refracting sheet 480 is superimposed on the symbol 501*i*. It is possible to enhance effects by light which illuminates the symbol 501*i*.

As a parameter representing the corrugations, there is the interval or height (depth) of the convex portions or the concave portions, the length in the longitudinal direction, or the like. As the interval of the convex portions or the concave portions, for example, the average interval of two adjacent convex portions or the average interval of two adjacent concave portions may be used. As the interval or height of the convex portions or the concave portions, the average height from a trough of an adjacent concave portion to an apex of a convex portion may be used. The length is appropriately determined, thereby determining the degree of reflection or refraction. As a parameter representing the corrugations, there is also the direction in the longitudinal direction of the convex portions or the concave portions. The direction of reflection or refraction can be determined by the direction in the longitudinal direction. These parameters can be determined taking into consideration the wavelength of light to be used or the like.

No corrugations are formed on each of the second front surfaces 464, 474, and 484. The second front surfaces 464, 474, and the 484 are finished smoothly compared to the first front surfaces 462, 472, and 482.

In addition to the sandblasting method or the embossing method described above, light transmitting particulates may be attached to the light refracting sheets 460, 470, and 480 to form corrugations. In addition, an energy beam, such as laser, may be irradiated onto the light refracting sheets 460, 470, and 480 to form corrugations. Any method may be used insofar as corrugations can be formed.

In the above-described example, although a case where corrugations are formed in a lattice shape has been described, corrugations may have a regular shape as well as the lattice shape. It should suffice that incident light can be reflected or refracted in a predetermined direction based on the corrugations formed regularly.

Figure 11A:
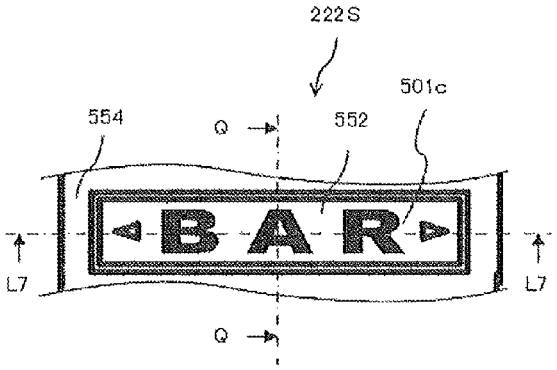
FIG. 11A is a diagram showing the region where the symbol 501*c* is formed.
Figure 11C:
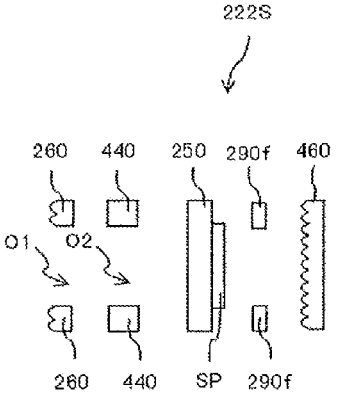
FIG. 11C is a diagram showing the region where the symbol 501*c* is formed.
Figure 11B:
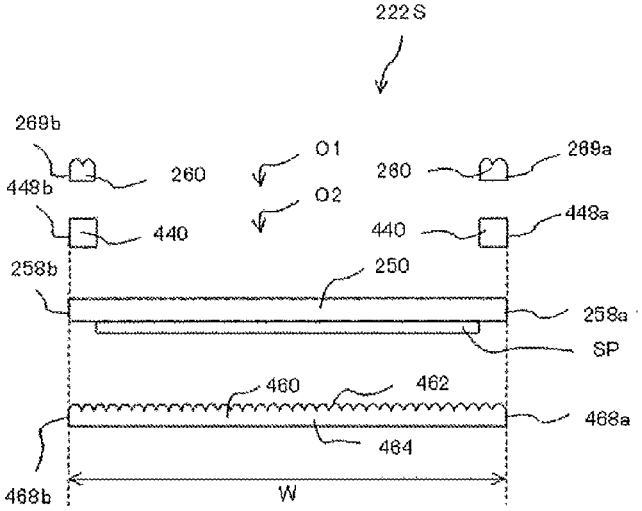
FIG. 11B is a diagram showing the region where the symbol 501*c* is formed.
Figure 12A:
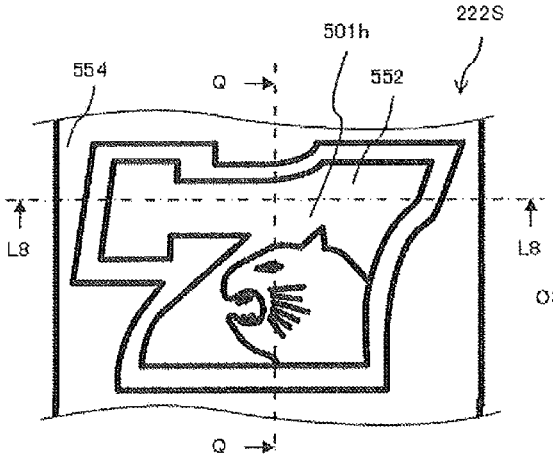
FIG. 12A is a diagram showing the region where the symbol 501*h* is formed.
Figure 12C:
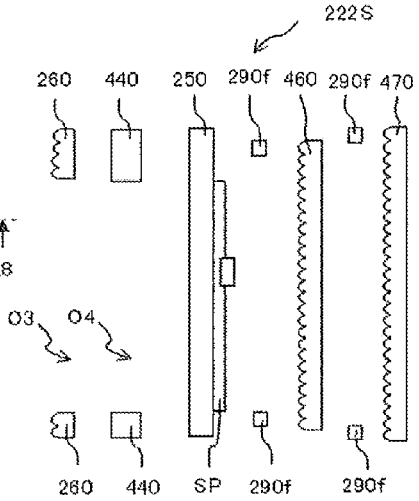
FIG. 12C is a diagram showing the region where the symbol 501*h* is formed.
Figure 12B:
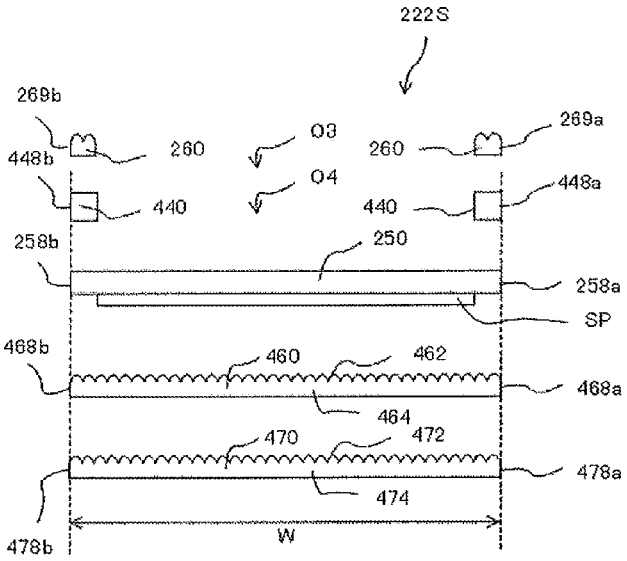
FIG. 12B is a diagram showing the region where the symbol 501*h* is formed.

As shown in FIG. 11B and FIG. 12B, the light refracting sheet 460 has two ends of a first end 468*a* and a second end 468*b*. The width between the two ends of the first end 468*a* and the second end 468*b* is W. As shown in FIG. 12B, the light refracting sheet 470 has two ends of a first end 478*a* and a second end 478*b*. The width between the two ends of the first end 478*a* and the second end 478*b* is W. As shown in FIG. 13B, the light refracting sheet 480 has two ends of a first end 488*a* and a second end 488*b*. The width between the two ends of the first end 488*a* and the second end 488*b* is W.

<Symbol Display Sheet 490>

Figure 14C:
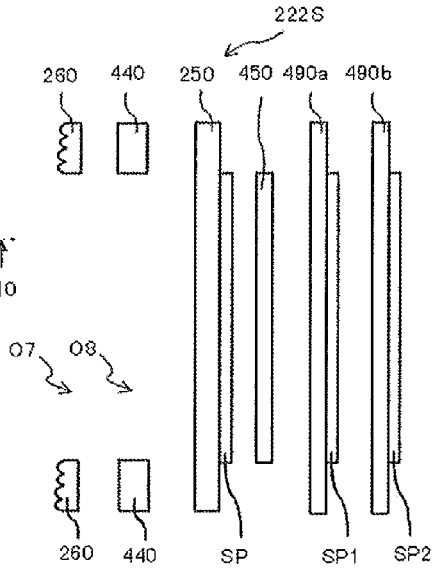
FIG. 14C is a diagram showing the region where the symbol 501*g* is formed.
Figure 14B:
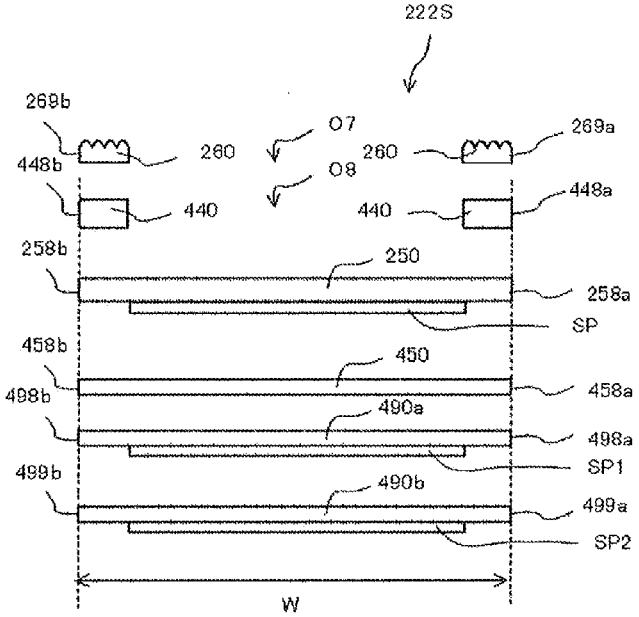
FIG. 14B is a diagram showing the region where the symbol 501*g* is formed.
Figure 15A:
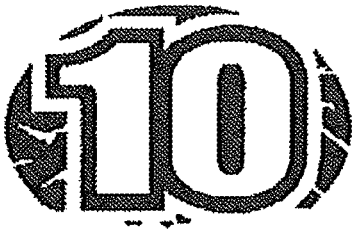
FIG. 15A is a diagram showing a symbol printed on the symbol display sheet 490.
Figure 15B:
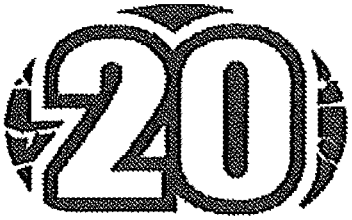
FIG. 15B is a diagram showing a symbol printed on the symbol display sheet 490.

FIG. 15 is a diagram showing a symbol printed on the symbol display sheet 490. The symbol display sheet 490 is a sheet for the symbol 501*g*. As shown in FIG. 14B and FIG. 14C, the symbol display sheet 490 has symbol display sheets 490*a* and 490*b*. A number "10" is printed in green on the symbol display sheet 490*a* (FIG. 15A). A number "20" is printed in red on the symbol display sheet 490*b* (FIG. 15B). The symbol display sheets 490*a* and 490*b* overlap each other. In this way, on the symbol display sheet 490*a* and the symbol display sheet 490*b*, symbols are printed in complementary colors.

When red light is emitted from the light source device 304 of the backlight device 300, the number "10" printed in green appears as the symbol 501*g*. When green light is emitted from the light source device 304 of the backlight device 300, the number "20" printed in red appears as the symbol 501*g*. In this way, the color emitted from the light source device 304 of the backlight device 300 changes, thereby switching the symbol to appear. In this way, the symbol 501*g* is not a single symbol, and is a symbol in which different symbols are selectively switched.

<Double-Sided Tape 290*f* and Double-Sided Tape 290*d*>

Double-sided tapes 290*f* bond the light refracting sheets 460 and 470 to the front surface sheet 250. As shown in FIG. 8, the double-sided tapes 290*f* are disposed along a latitudinal direction of the front surface sheet 250 (a direction perpendicular to the longitudinal direction of the front surface sheet 250). Specifically, the double-sided tapes 290*f* are tapes for bonding the two ends of the light refracting sheets 460 and 470 to the front surface sheet 250 along the latitudinal direction of the front surface sheet 250, where the two ends face each other and are separated from each other.

A gap which is communicated along the latitudinal direction of the front surface sheet 250 can be formed between the front surface sheet 250 and the light refracting sheet 460 by the double-sided tapes 290*f*. Similarly, the light refracting sheet 470 is disposed so as to be superimposed on the light refracting sheet 460 in the symbol 501*h* by the double-sided tapes 290*f*. Accordingly, a gap which is communicated along the latitudinal direction of the front surface sheet 250 can be formed between the light refracting sheet 460 and the light refracting sheet 470.

The double-sided tape 290*d* fixes the reel band 222 to an opposite end portion 240 of the reel band 222 when attaching the reel band 222 to the reel 220. In FIG. 8, the double-sided tape 290*d* is represented by a bold solid line. The reel band 222 is fixed to the end portion 240, whereby it is possible to wind and attach the reel band 222 around and to the reel 220 without forming a gap.

<Bonding of Reflecting Sheet 440 and Front Surface Sheet 250>

The reflecting sheet 440 is attached to the front surface of the front surface sheet 250. An adhesive is applied over the whole second front surface 444 of the reflecting sheet 440. The reflecting sheet 440 can be attached firmly to the front surface sheet 250 by the adhesive.

<Bonding of Light Diffusing Sheet 260 and Reflecting Sheet 440>

The light diffusing sheet 260 is attached to the first front surface 442 of the reflecting sheet 440. An adhesive is applied over the whole second front surface 264 of the light diffusing sheet 260. The adhesive is transparent and can transmit light. The light diffusing sheet 260 can be attached firmly to the reflecting sheet 440 by the adhesive.

<<Actual Symbol Forming Region 552 and Actual Symbol Non-Forming Region 554>>

The reel band 222S has actual symbol forming regions 552 and actual symbol non-forming regions 554. That is, the actual symbol forming region 552 is a region where only a symbol to be visually recognized by the player is formed. Accordingly, in this embodiment, no blank symbol is included in the actual symbol forming region 552. The actual symbol forming region 552 is only a region where a symbol is formed, and a peripheral region surrounding a symbol or a region around a symbol is not included in the actual symbol forming region 552.

The actual symbol non-forming region 554 is a region other than a region where a symbol to be visually recognized by the player is formed. As shown in FIG. 8, the light diffusing sheet 260 of this embodiment is disposed only in the actual symbol non-forming region 554, and is not disposed in the actual symbol forming region 552. A peripheral region surrounding a symbol or a region around a symbol is the actual symbol non-forming region 554. As shown in FIG. 8 (b-1), the light diffusing sheet 260 is disposed only in the actual symbol non-forming region 554, and is not disposed in the actual symbol forming region 552.

<Configuration of Actual Symbol Non-Forming Region 554>

Figure 9A:
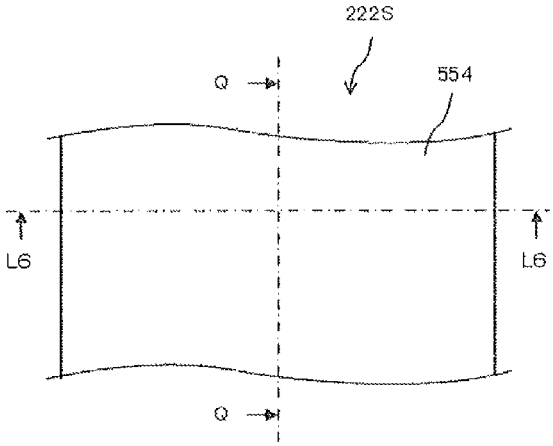
FIG. 9A is a diagram showing the actual symbol non-forming region 554.
Figure 9C:
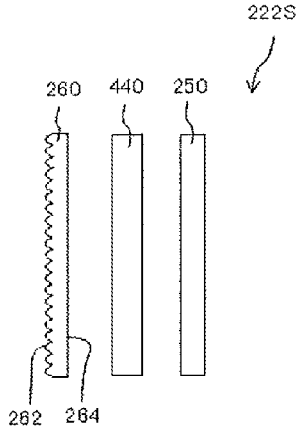
FIG. 9C is a diagram showing the actual symbol non-forming region 554.
Figure 9B:
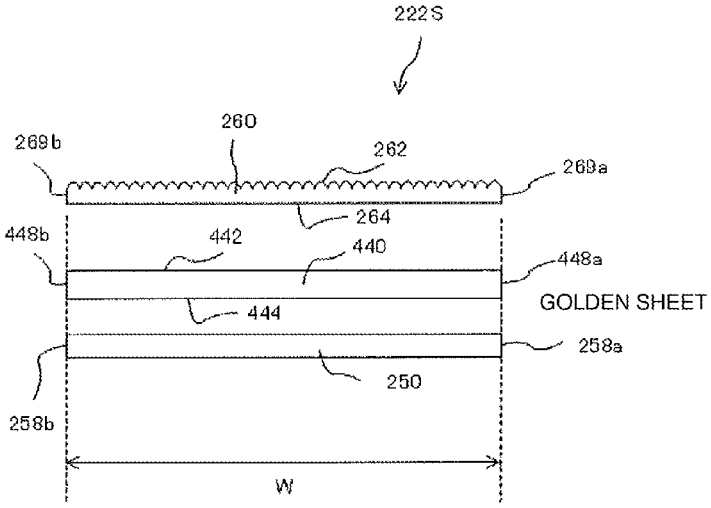
FIG. 9B is a diagram showing the actual symbol non-forming region 554.

FIG. 9 is a diagram showing the actual symbol non-forming region 554. Specifically, FIG. 9A is a front view showing the front surface of the actual symbol non-forming region 554. FIG. 9B is a transverse sectional view showing the section of the actual symbol non-forming region 554 taken along a section L6-L6. FIG. 9C is a longitudinal sectional view showing the section of the actual symbol non-forming region 554 taken along a section Q-Q. In FIG. 9B and FIG. 9C, in order to clearly show the configuration, the light diffusing sheet 260, the reflecting sheet 440, and the front surface sheet 250 are shown separately.

In the actual symbol non-forming region 554, since no symbol is printed on the front surface sheet 250, a printing surface SP is not formed.

As shown in FIG. 9A, no symbol is formed in the actual symbol non-forming region 554. In the actual symbol non-forming region 554, as shown in FIG. 9B and FIG. 9C, the reflecting sheet 440 is provided on the front surface of the front surface sheet 250. The light diffusing sheet 260 is provided on the front surface of the reflecting sheet 440.

An adhesive is applied to the whole second front surface 444 of the reflecting sheet 440, and the reflecting sheet 440 is attached firmly to the front surface of the front surface sheet 250. Similarly, an adhesive is applied to the whole second front surface 264 of The light diffusing sheet 260, and The light diffusing sheet 260 is attached firmly to the first front surface 442 of the reflecting sheet 440.

<Reflection of Light in Actual Symbol Non-Forming Region 554>

Figure 10:
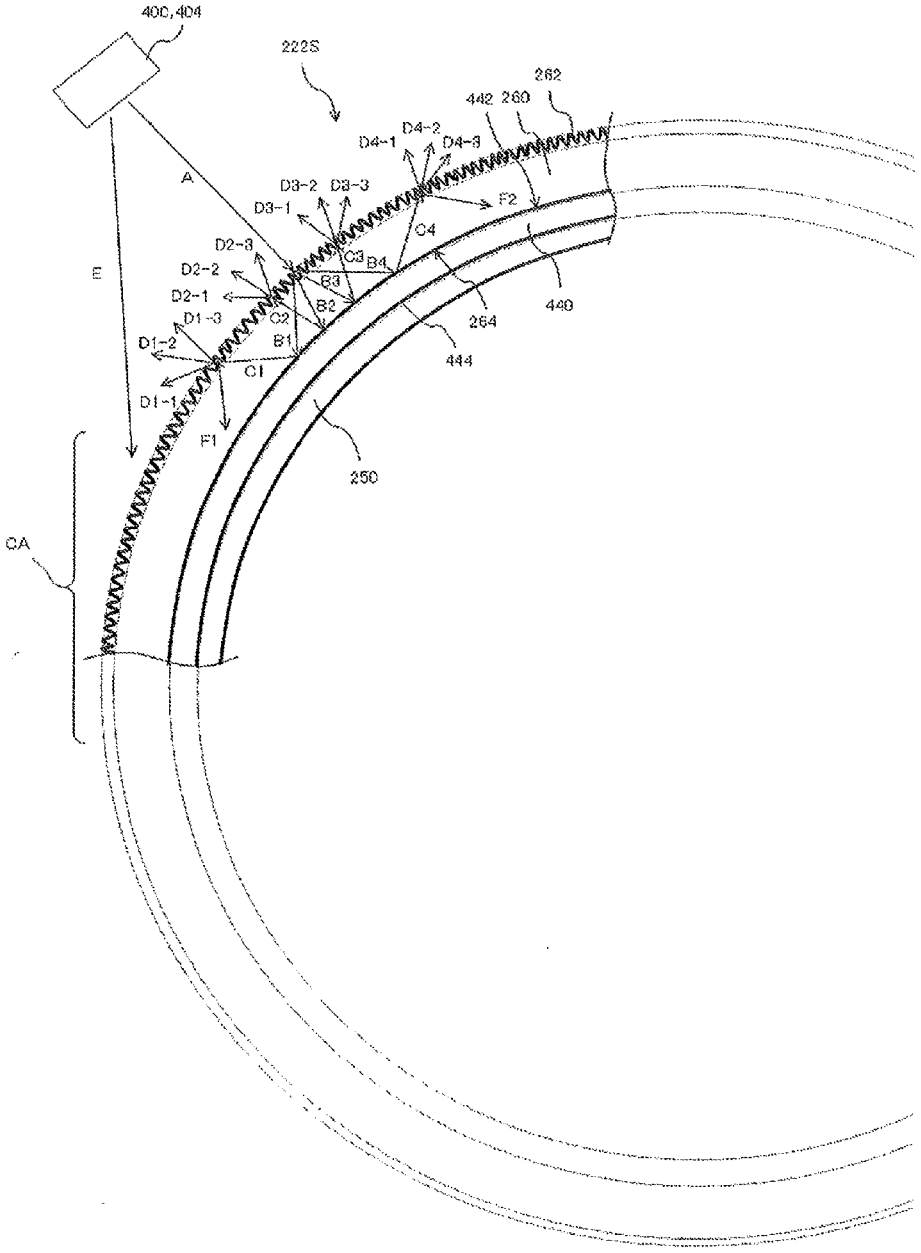
FIG. 10 is a diagram showing light emitted from the light source device 404 of the front light device 400 is reflecting and being refracted.

As shown in FIG. 10, light A emitted from the light source device 404 of the front light device 400 illuminates the reel band 222S. Light which illuminates the reel band 222S is incident on the first front surface 262 of the light diffusing sheet 260.

Part of light incident on the first front surface 262 is reflected and the remainder (B1, B2, B3, and B4) of light is refracted by the corrugations formed on the first front surface 262. Reflected light and refracted light by the corrugations spread with distance from the light diffusing sheet 260. In this way, light incident on the light diffusing sheet 260 is diffused by the corrugations.

Light (B1, B2, B3, and B4) refracted by the corrugations travels inside the light diffusing sheet 260, is emitted from the second front surface 264, and reaches the reflecting sheet 440. Light which reaches the reflecting sheet 440 is reflected by the first front surface 442 of the reflecting sheet 440 and is incident on the second front surface 264 of the light diffusing sheet 260 (C1, C2, C3, and C4). Light incident on the second front surface 264 travels inside the light diffusing sheet 260 again and reaches the first front surface 262. When the reflecting sheet 440 has high reflectance and low transmittance, a small amount of light is transmitted through the reflecting sheet 440.

Light which reaches the first front surface 262 is refracted by the corrugations formed on the first front surface 262 and is emitted from the first front surface 262 (D1-1, D1-2, D1-3, D2-1, D2-2, D2-3, D3-1, D3-2, D3-3, D4-1, D4-2, and D4-3). In this way, refraction by the corrugations formed on the first front surface 262 and reflection by the reflecting sheet 440 allows light emitted from the light source device 404 of the front light device 400 to spread in various directions. Each time light is transmitted through the light diffusing sheet 260, light is refracted in multiple directions, and light is gradually diffused to spread in a wide range, whereby it is possible to enhance the illumination effect of the reels 220.

As shown in FIG. 7, the light source device 404 of the front light device 400 is provided on both the upper rear side of the display window 150 and the lower rear side of the display window 150. The light source device 404 provided on the upper rear side of the display window 150 emits light toward the upper side of the reel band 222S. The light source device 404 provided on the lower rear side of the display window 150 emits light toward the lower side of the reel band 222S. With this, the front light device 400 can illuminate the upper side and the lower side of the reel band 222S brightly.

As shown in FIG. 10, an intermediate region CA between the upper side and the lower side of the reel band 222S is separated from the upper and lower light source devices 404, and light E emitted from the front light device 400 is less likely to reach the intermediate region CA. Furthermore, as shown in FIG. 7 and FIG. 10, the intermediate region CA of the reel band 222S protrudes in front of the gaming machine 10 from the light source device 404. For this reason, light E emitted from the light source device 404 is blocked by the intermediate region CA of the reel band 222S. Accordingly, light emitted from the upper light source device 404 does not illuminate the reel band 222S lower than the intermediate region CA. Similarly, light emitted from the lower light source device 404 does not illuminate the reel band 222S upper than the intermediate region CA.

With this configuration, the reel band 222S can be illuminated while gradually changing light-dark such that the upper side and the lower side of the reel band 222S are brightest and the intermediate region CA is dark. That is, the reel band 222S can be illuminated while forming gradation along the longitudinal direction of the reel band 222S in the display window 150.

As shown in FIG. 3, the light source device 304 of the backlight device 300 is disposed along the reel band 222S. Accordingly, if intensity of light emitted from the light source device 304 of the backlight device 300 is constant, the symbols 501 of the reel band 222S can be illuminated with constant brightness.

In the actual symbol forming region 552 where the symbol 501 is formed, the symbol 501 is illuminated with constant brightness by the backlight device 300. In the actual symbol non-forming region 554 where no symbol 501 is formed, the reel band 222S is illuminated while forming gradation along the longitudinal direction of the reel band 222S by the front light device 400. In this way, it is possible to enhance the illumination effect of the reels 220 by illumination of both the backlight device 300 and the front light device 400.

In the actual symbol non-forming region 554, the edge of the reel band 222S is formed by the first end 269*a* of the light diffusing sheet 260, the first end 248*a* of the reflecting sheet 440, and the first end 258*a* of the front surface sheet 250. This edge is fitted into the driving reel frame body 226. Similarly, the edge of the reel band 222S is formed by the second end 269*b* of the light diffusing sheet 260, the second end 248*b* of the reflecting sheet 440, and the second end 258*b* of the front surface sheet 250. This edge is fitted into the driving reel frame body 228.

As shown in FIG. 10, light reflected by the first front surface 442 of the reflecting sheet 440 is incident on the second front surface 264 of the light diffusing sheet 260. Part of light incident on the second front surface 264 of the light diffusing sheet 260 is emitted from the first front surface 262 (D1-1, D1-2, D1-3, D2-1, D2-2, D2-3, D3-1, D3-2, D3-3, D4-1, D4-2, and D4-3).

The remainder of light incident on the second front surface 264 of the light diffusing sheet 260 is reflected by the second front surface 264 and travels inside the light diffusing sheet 260 again (F1 and F2). Light F1 or F2 is repeatedly reflected and travels inside the light diffusing sheet 260. With the repeated reflection, it is possible to allow the light diffusing sheet 260 to function as a light guide body. The light diffusing sheet 260 functions as a light guide body, whereby it is possible to allow light A emitted from the light source device 404 of the front light device 400 to propagate inside the light diffusing sheet 260, thereby spreading light A.

As described above, light E emitted from the front light device 400 is less likely to reach the intermediate region CA. However, the light diffusing sheet 260 allows light A emitted from the light source device 404 of the front light device 400 to propagate inside the light diffusing sheet 260. Accordingly, a region separated from the upper and lower light source devices 404, for example, a region, such as the intermediate region CA, can be illuminated brightly. The reel band 222S can be illuminated only with light emitted from the front light device 400. Since the reel band 222S can be illuminated only with light from the front light, it is possible to increase the degree of freedom to select a material of the reel band.

<<Actual Symbol Forming Region 552>>

The actual symbol forming regions 552 include regions where the symbol 501*c*, the symbol 501*d*, and the symbol 501*e* are formed, a region where the symbol 501*h* is formed, a region where the symbol 501*i* is formed, and a region where the symbol 501*g* is formed.

<Regions where Symbol 501*c*, Symbol 501*d*, and Symbol 501*e* are Formed>

The symbol 501*c* is a symbol which represents one "BAR". The symbol 501*d* is a symbol which represents two "BAR". The symbol 501*e* is a symbol which represents three "BAR".

As shown in FIG. 8 (b-1) and (b-2) and FIG. 11B and FIG. 11C, in the regions where the symbol 501*c*, the symbol 501*d*, and the symbol 501*e* are formed, an opening O1 conforming to the appearance of each of the symbols is formed in the reflecting sheet 440, and an opening O2 conforming to the appearance of each of the symbols is formed in the light diffusing sheet 260.

FIG. 11 is a diagram showing the region where the symbol 501*c* is formed. Specifically, FIG. 11A is a front view showing the front surface of the region where the symbol 501*c* is formed. FIG. 11B is a transverse sectional view showing the section of the region, in which the symbol 501*c* is formed, taken along a section L7-L7. FIG. 11C is a longitudinal sectional view showing the section of the region, in which the symbol 501*c* is formed, taken along a section Q-Q. The regions where the symbol 501*d* and the symbol 501*e* are formed have the same configuration. In FIG. 11B and FIG. 11C, in order to clearly show the configuration, the front surface sheet 250, the light refracting sheet 460, and the double-sided tapes 290*f* are shown separately.

In FIG. 11B and FIG. 11C, in order to clearly show a surface on which the symbol 501*c* is printed, a printing surface SP is clarified. The symbol "BAR" is printed on the rear surface of the front surface sheet 250. The region of the printing surface SP is the actual symbol forming region 552.

In FIG. 11B, the light source device 304 of the backlight device 300 is provided on the lower side of the drawing (not shown). Light emitted from the light source device 304 of the backlight device 300 is emitted from the lower side and illuminates the light refracting sheet 460. Light transmitted through the light refracting sheet 460 illuminates the printing surface SP. Light which illuminates the printing surface SP passes through the front surface sheet 250 and travels toward the upper side of the drawing through the openings O1 and O2. In this way, light emitted from the light source device 304 of the backlight device 300 passes through the region of the reel band 222S where the symbol 501*c* is formed and travels toward the front side of the gaming machine 10.

Light emitted from the light source device 304 of the backlight device 300 illuminates the symbol 501*c*. The symbol 501*c* printed on the front surface sheet 250 appears to be visually recognized through the openings O2 and O1.

As shown in FIG. 11C, in the actual symbol forming region 552, the double-sided tapes 290*f* are provided in the two end portions of the light refracting sheet 460. As shown in FIG. 8 (*d*), the double-sided tapes 290*f* are disposed along the latitudinal direction of the front surface sheet 250. The light refracting sheet 460 can be fixed to the printing surface SP of the front surface sheet 250 by the double-sided tape 290*f*. The light refracting sheet 460 and the front surface sheet 250 are bonded together by the double-sided tapes 290*f* provided in the two end portions to be communicated with each other along the latitudinal direction of the front surface sheet 250.

The corrugations are formed regularly on the first front surface 462 of the light refracting sheet 460. Light incident on the light refracting sheet 460 can be reflected or refracted in a direction in accordance with the corrugations. The light refracting sheet 460 is disposed to overlap the symbol 501*c*, the symbol 501*d*, and the symbol 501*e*, whereby light incident on the light refracting sheet 460 can be reflected or refracted in a predetermined direction based on the corrugations of the light refracting sheet 460. With this, it is possible to illuminate the actual symbol forming region 552 so as to be different from the actual symbol non-forming region 554, and to accent the actual symbol forming region 552 by light emitted from the light source device 304.

As shown in FIG. 11B, the edge of the reel band 222S is formed by the first end 269*a* of the light diffusing sheet 260, the first end 248*a* of the reflecting sheet 440, the first end 258*a* of the front surface sheet 250, and the first end 468*a* of the light refracting sheet 460. This edge is fitted into the driving reel frame body 226. Similarly, the edge of the reel band 222S is formed by the first end 269*b* of the light diffusing sheet 260, the first end 248*b* of the reflecting sheet 440, the first end 258*b* of the front surface sheet 250, and the first end 468*b* of the light refracting sheet 460. This edge is fitted into the driving reel frame body 228.

<Region where Symbol 501*h* is Formed>

The symbol 501*h* is a symbol having an appearance in which the shape of the number "7" is printed. As shown in FIG. 8 (b-1) and (b-2) and FIG. 12B and FIG. 12C, similarly to the symbol 501*c*, the symbol 501*d*, and the symbol 501*e*, in the region where the symbol 501*h* is formed, an opening O3 conforming to the appearance of the symbol 501*h* is formed in the reflecting sheet 440, and an opening O4 conforming the appearance of the symbol 501*h* is formed in the light diffusing sheet 260.

FIG. 12 is a diagram showing the region where the symbol 501*h* is formed. Specifically, FIG. 12A is a front view showing the front surface of the region where the symbol 501*h* is formed. FIG. 12B is a transverse sectional view showing the section of the region, in which the symbol 501*h* is formed, taken along a section L8-L8. FIG. 12C is a longitudinal sectional view showing the section of the region, in which the symbol 501*h* is formed, taken along a section Q-Q. In FIG. 12B and FIG. 12C, in order to clearly show the configuration, the front surface sheet 250, the light diffusing sheet 260, the reflecting sheet 440, the light refracting sheet 460, the light refracting sheet 470, and the double-sided tapes 290*f* are shown separately.

In FIG. 12B and FIG. 12C, in order to clearly show the surface on which the symbol 501*h* is printed, the printing surface SP is clarified. The symbol "7" and the pattern are printed on the rear surface of the front surface sheet 250. The region of the printing surface SP is the actual symbol forming region 552.

In FIG. 12B, the light source device 304 of the backlight device 300 is provided on the lower side of the drawing (not shown). Light emitted from the light source device 304 of the backlight device 300 is emitted from the lower side and illuminates the light refracting sheet 470. Light transmitted through the light refracting sheet 470 illuminates the light refracting sheet 460. Light transmitted through the light refracting sheet 460 illuminates the printing surface SP. Light which illuminates the printing surface SP passes through the front surface sheet 250 and travels toward the upper side of the drawing through the openings O4 and O3. In this way, light emitted from the light source device 304 of the backlight device 300 passes through the region of the reel band 222S where the symbol 501*c* is formed and travels toward the front side of the gaming machine 10.

In this way, light emitted from the light source device 304 of the backlight device 300 illuminates the symbol 501*h*. The symbol 501*h* printed on the front surface sheet 250 appears to be visually recognized through the openings O3 and O4.

As shown in FIG. 12C, in the actual symbol forming region 552, the double-sided tapes 290*f* are provided in the two end portions of the light refracting sheet 460. As shown in FIG. 8 (*d*), the double-sided tapes 290*f* are disposed along the latitudinal direction of the front surface sheet 250. The light refracting sheet 460 can be fixed to the printing surface SP of the front surface sheet 250 by the double-sided tapes 290*f*. The light refracting sheet 460 and the front surface sheet 250 are bonded together by the double-sided tapes 290*f* provided in the two end portions to be communicated with each other along the latitudinal direction of the front surface sheet 250.

As shown in FIG. 12C, in the actual symbol forming region 552, the double-sided tapes 290*f* are provided in the two end portions of the light refracting sheet 470. The light refracting sheet 470 and the front surface sheet 250 are bonded together by the double-sided tapes 290*f* provided in the two end portions to be communicated with each other along the latitudinal direction of the front surface sheet 250.

The corrugations are formed regularly on each of the first front surface 462 of the light refracting sheet 460 and the first front surface 472 of the light refracting sheet 470. Light incident on the light refracting sheet 460 and the light refracting sheet 470 can be reflected or refracted in a direction in accordance with the corrugations. The light refracting sheet 460 and the light refracting sheet 470 are disposed to overlap the symbol 501*h*, whereby light incident on the light refracting sheet 460 and the light refracting sheet 470 can be reflected or refracted in a predetermined direction based on the corrugations of the light refracting sheet 460 and the light refracting sheet 470. With this, it is possible to illuminate the actual symbol forming region 552 so as to be different from the actual symbol non-forming region 554, and to accent the actual symbol forming region 552 by light emitted from the light source device 304.

As shown in FIG. 12B, the edge of the reel band 222S is formed by the first end 269*a* of the light diffusing sheet 260, the first end 248*a* of the reflecting sheet 440, the first end 258*a* of the front surface sheet 250, the first end 468*a* of the light refracting sheet 460, and the first end 478*a* of the light refracting sheet 470. This edge is fitted into the driving reel frame body 226. Similarly, the edge of the reel band 222S is formed by the second end 269*b* of the light diffusing sheet 260, the second end 248*b* of the reflecting sheet 440, the second end 258*b* of the front surface sheet 250, the second end 468*b* of the light refracting sheet 460, and the second end 478*b* of the light refracting sheet 470. This edge is fitted into the driving reel frame body 228.

<Region where Symbol 501*i* is Formed>

The symbol 501*i* is a symbol having an appearance in which the shape of the number "7" is printed. As shown in FIG. 8 (b-1) and (b-2) and FIG. 13B and FIG. 13C, similarly to the symbol 501*c*, the symbol 501*d*, and the symbol 501*e*, in the region where the symbol 501*i* is formed, an opening O5 conforming to the appearance of the symbol 501*i* is formed in the reflecting sheet 440, and an opening O6 conforming to the appearance of the symbol 501*i* is formed in the light diffusing sheet 260.

Figure 13A:
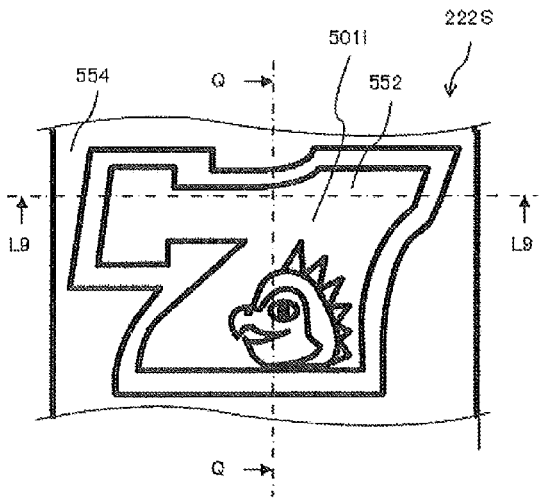
FIG. 13A is a diagram showing the region where the symbol 501*i* is formed.
Figure 13C:
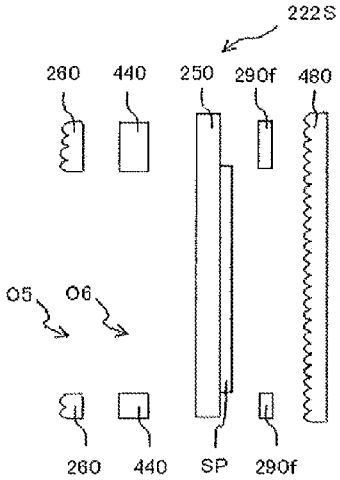
FIG. 13C is a diagram showing the region where the symbol 501*i* is formed.
Figure 13B:
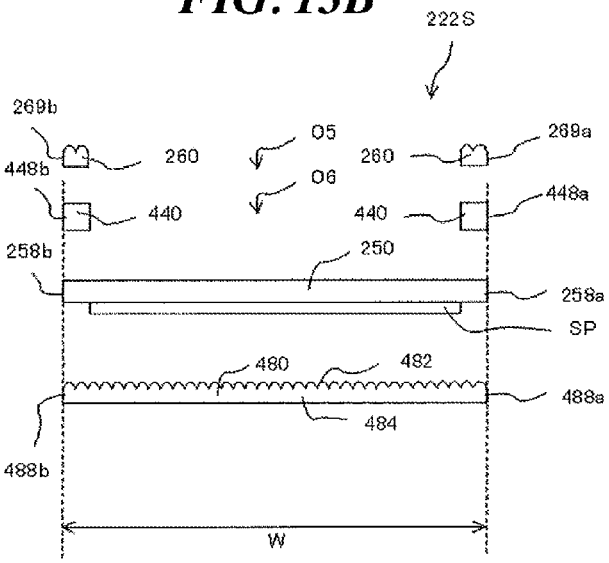
FIG. 13B is a diagram showing the region where the symbol 501*i* is formed.

FIG. 13 is a diagram showing the region where the symbol 501*i* is formed. Specifically, FIG. 13A is a front view showing the front surface of the region where the symbol 501*i* is formed. FIG. 13B is a transverse sectional view showing the section of the region, in which the symbol 501*i* is formed, taken along a section L9-L9. FIG. 13C is a longitudinal sectional view showing the section of the region, in which the symbol 501*i* is formed, taken along a section Q-Q. In FIG. 13B and (FIG. 13C), in order to clearly show the configuration, the front surface sheet 250, the light diffusing sheet 260, the reflecting sheet 440, and the light refracting sheet 480 are shown separately.

In FIG. 13B and FIG. 13C, in order to clearly show the surface on which the symbol 501*i* is printed, the printing surface SP is clarified. The symbol "7" and the pattern are printed on the rear surface of the front surface sheet 250. The region of the printing surface SP is the actual symbol forming region 552.

In FIG. 13B, the light source device 304 of the backlight device 300 is provided on the lower side of the drawing (not shown). Light emitted from the light source device 304 of the backlight device 300 is emitted from the lower side and illuminates the light refracting sheet 480. Light transmitted through the light refracting sheet 480 illuminates the printing surface SP. Light which illuminates the printing surface SP passes through the front surface sheet 250 and travels toward the upper side of the drawing through the openings O6 and O5. In this way, light emitted from the light source device 304 of the backlight device 300 passes through the region of the reel band 222S where the symbol 501*i* is formed and travels toward the front side of the gaming machine 10.

In this way, light emitted from the light source device 304 of the backlight device 300 illuminates the symbol 501*i*. The symbol 501*i* printed on the front surface sheet 250 appears to be visually recognized through the openings O5 and O6.

The light refracting sheet 480 is bonded to the rear surface of the front surface sheet 250 by an adhesive, a double-sided tape, or the like (not shown).

The corrugations are formed regularly on the first front surface 482 of the light refracting sheet 480. Light incident on the light refracting sheet 480 can be reflected or refracted in a direction in accordance with the corrugations. The light refracting sheet 480 is disposed to overlap the symbol 501*i*, whereby light incident on the light refracting sheet 480 can be reflected or refracted in a predetermined direction based on the corrugations of the light refracting sheet 480. Accordingly, it is possible to illuminate the actual symbol forming region 552 so as to be different from the actual symbol non-forming region 554, and to accent the actual symbol forming region 552 by light emitted from the light source device 304.

As shown in FIG. 13B, the edge of the reel band 222S is formed by the first end 269*a* of the light diffusing sheet 260, the first end 248*a* of the reflecting sheet 440, the first end 258*a* of the front surface sheet 250, and the first end 488*a* of the light refracting sheet 480. This edge is fitted into the driving reel frame body 226. Similarly, the edge of the reel band 222S is formed by the second end 269*b* of the light diffusing sheet 260, the second end 248*b* of the reflecting sheet 440, the second end 258*b* of the front surface sheet 250, and the second end 488*b* of the light refracting sheet 480. This edge is fitted into the driving reel frame body 228.

<Region where Symbol 501*g* is Formed>

The symbol 501*g* is a symbol which represents the character "FREE GAME" and the number "10" or "20". As shown in FIG. 8 (b-1) and (b-2) and FIG. 14B and FIG. 14C, in the region where the symbol 501*g* is formed, the reflecting sheet 440 is separated and has an opening O7, and the light diffusing sheet 260 is separated and has an opening O8.

Figure 14A:
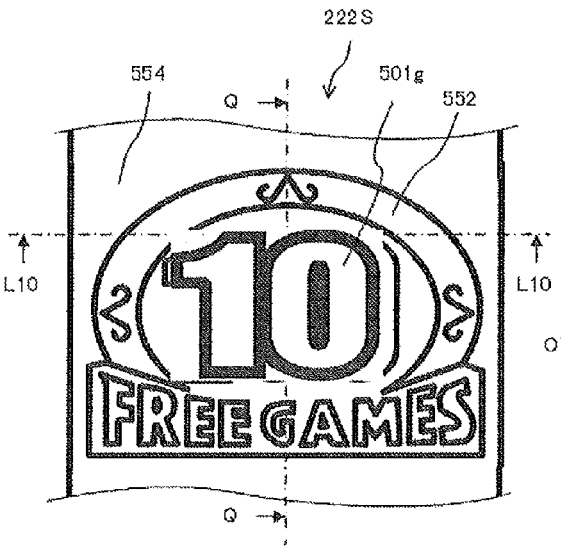
FIG. 14A is a diagram showing the region where the symbol 501*g* is formed.

FIG. 14 is a diagram showing the region where the symbol 501*g* is formed. Specifically, FIG. 14A is a front view showing the front surface of the region where the symbol 501*g* is formed. FIG. 14B is a transverse sectional view showing the section of the region, in which the symbol 501*g* is formed, taken along a section L10-L10. FIG. 14C is a longitudinal sectional view showing the section of the region, in which the symbol 501*g* is formed, taken along a section Q-Q. In FIG. 14B and FIG. 14C, in order to clearly show the configuration, the front surface sheet 250, the light diffusing sheet 260, the reflecting sheet 440, the light dimming sheet 450, and the symbol display sheets 490*a* and 490*b* are shown separately.

In FIG. 14B and FIG. 14C, in order to clearly show the surface on which the symbol 501*g* is printed, printing surfaces SP, SP1, and SP2 are clarified. The character "FREE GAME" and the pattern are printed in black as the printing surface SP on the rear surface of the front surface sheet 250. The number "10" is printed in green as the printing surface SP1 on the rear surface of the symbol display sheet 490*a* (FIG. 15A). The number "20" is printed in red as the printing surface SP2 on the rear surface of the symbol display sheet 490*b* (FIG. 15B). The region where the printing surfaces SP, SP1, and SP2 are superimposed is the actual symbol forming region 552. The symbol 501*g* is formed by the printing surfaces SP, SP1, and SP2.

In FIG. 14B, the light source device 304 of the backlight device 300 is provided on the lower side of the drawing (not shown). Light emitted from the light source device 304 of the backlight device 300 is emitted from the lower side and illuminates the printing surface SP2. Light which illuminates the printing surface SP2 passes through the symbol display sheet 490*b*. Light which passes through the symbol display sheet 490*b* illuminates the printing surface SP1. Light which illuminates the printing surface SP1 passes through the symbol display sheet 490*a*. Light which passes through the symbol display sheet 490*a* is incident on the light dimming sheet 450. Light decreases in intensity by the light dimming sheet 450 and is emitted from the light dimming sheet 450. Light emitted from the light dimming sheet 450 illuminates the printing surface SP. Light which illuminates the printing surface SP passes through the front surface sheet 250 and travels toward the upper side of the drawing through the openings O8 and O7. In this way, light emitted from the light source device 304 of the backlight device 300 passes through the region of the reel band 222S where the symbol 501*g* is formed and travels toward the front side of the gaming machine 10.

In this way, light emitted from the light source device 304 of the backlight device 300 illuminates the symbol 501*g*. The symbol 501*g* printed on the front surface sheet 250 appears to be visually recognized through the openings O7 and O8.

As described above, green of the number "10" of the printing surface SP1 and red of the number "20" of the printing surface SP2 are complementary colors. For this reason, when red light is emitted from the light source device 304 of the backlight device 300, the number "10" printed in green appears as the symbol 501*g*. When green light is emitted from the light source device 304 of the backlight device 300, the number "20" printed in red appears as the symbol 501*g*.

As described above, the character "FREE GAME" and the pattern of the printing surface SP are printed in black. For this reason, even when the color of light emitted from the light source device 304 of the backlight device 300 is red or green, the character "FREE GAME" and the pattern of the printing surface SP constantly appear as the symbol 501*g*.

Accordingly, when the color of light emitted from the light source device 304 of the backlight device 300 is red, the number "10" printed in green on the printing surface SP1 and the character "FREE GAME" and the pattern of the printing surface SP appear as the symbol 501*g*. When the color of light emitted from the light source device 304 of the backlight device 300 is green, the number "20" printed in red on the printing surface SP2 and the character "FREE GAME" and the pattern of the printing surface SP appear as the symbol 501*g*.

The light dimming sheet 450 is disposed to overlap the printing surfaces SP, SP1, and SP2. The light dimming sheet 450 is a sheet for lowering intensity of light to be transmitted. The light dimming sheet 450 is disposed to overlap the printing surfaces SP, SP1, and SP2, whereby, when the color of light emitted from the light source device 304 is red, the number "10" printed in green on the printing surface SP1 appears, and the number "20" printed in red on the printing surface SP2 is less likely to appear. Similarly, when the color of light emitted from the light source device 304 is green, the number "20" printed in red on the printing surface SP2 appears, and the number "10" printed in green on the printing surface SP1 is less likely to appear.

The light dimming sheet 450 and the symbol display sheets 490*a* and 490*b* are bonded to the rear surface of the front surface sheet 250 by an adhesive, a double-sided tape, or the like (not shown).

As shown in FIG. 14B, the edge of the reel band 222S is formed by the first end 269*a* of the light diffusing sheet 260, the first end 248*a* of the reflecting sheet 440, the first end 258*a* of the front surface sheet 250, the first end 458*a* of the light dimming sheet 450, the first end 498*a* of the symbol display sheet 490*a*, and the first end 499*a* of the symbol display sheet 490*b*. This edge is fitted into the driving reel frame body 226. Similarly, the edge of the reel band 222S is formed by the second end 269*b* of the light diffusing sheet 260, the second end 248*b* of the reflecting sheet 440, the second end 258*b* of the front surface sheet 250, the second end 458*b* of the light dimming sheet 450, the second end 498*b* of the symbol display sheet 490*a*, and the second end 499*b* of the symbol display sheet 490*b*. This edge is fitted into the driving reel frame body 228.

All publications, patent applications and patents mentioned in the present specification are herein incorporated by reference to the same extent as if each individual publication or patent application was specifically and individually indicated to be incorporated by reference.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

DESCRIPTION OF REFERENCE NUMERALS AND SYMBOLS

10 a gaming machine
220*a*, 220*b*, 220*c*, 220*d*, 220*e* a reel
222S a reel band
250 a symbol display sheet (a base sheet)
260 a light diffusing sheet (a light diffusing sheet)
262 a first surface (a first light refracting surface)
300 a backlight device (a backlight)
400 a front light device (a front light)
440 a reflecting sheet (a light reflecting sheet)
442 a first front surface (a reflecting surface)

What is claimed is:

1. A reel band comprising:
a base sheet,
a light reflecting sheet having a reflecting surface for reflecting light from a front surface side, the light reflecting sheet being superimposed on the base sheet, and
a light diffusing sheet having a light refracting surface, the light refracting surface transmitting light and refracting the transmitted light in multiple directions, and the light diffusing sheet being superimposed on the light reflecting sheet,
wherein each of the light reflecting sheet and the light diffusing sheet have an opening passing therethrough at a location where a symbol is to be arranged, and,
wherein the reel band is configured to be attached to a rotatable reel of a gaming machine.

2. The reel band according to claim 1,
wherein
the base sheet has a light transmission property, and is configured to transmit light from a rear surface side thereof such that light is emitted through the opening.

3. The reel band of claim 1, wherein a portion of the base sheet is translucent.

4. The reel band of claim 1, wherein a portion of the base sheet is transparent.

5. The reel band of claim 1, wherein the base sheet includes a symbol.

6. The reel band of claim 5, wherein the symbol is translucent to a predetermined wavelength of light.

7. The reel band of claim 5, wherein the symbol is opaque to a predetermined wavelength of light.

8. The reel band of claim 1, comprising at least two base sheets, each of the base sheets including a symbol, each symbol having a color that is different from one another.

9. The reel band of claim 1, wherein when the reel band is attached to a rotatable reel of a gaming machine, the light diffusing sheet is positioned toward a front side of the gaming machine, the base sheet is positioned toward a rear side of the gaming machine, and the reflecting surface is positioned between the light diffusing sheet and the base sheet.

10. The reel band of claim 9, further comprising a light refracting sheet, wherein when the reel band is attached to a rotatable reel of a gaming machine, the light refracting sheet is positioned toward the rear side of the gaming machine such that the base sheet is positioned between the light reflecting sheet and the light refracting sheet.

11. The reel band of claim 9, further comprising a plurality of light refracting sheets, wherein when the reel band is attached to a rotatable reel of a gaming machine, the light refracting sheets are positioned toward the rear side of the gaming machine such that the base sheet is positioned between the light reflecting sheet and the light refracting sheets.

12. The reel band of claim 1, wherein the light diffusing sheet is light transmissive and has a surface thereof including a plurality of concave and convex portions.

13. The reel band of claim 12, wherein, when the reel band is attached to a rotatable reel of a gaming machine, the plurality of concave and convex portions are disposed toward a front side of the gaming machine.

14. A gaming machine comprising:

a reel assembly having rotatable reels and a front light illuminating the reels from outside, wherein each of the reels has a reel band, the real band including, a base sheet, a light reflecting sheet having a reflecting surface for reflecting light emitted from the front light, and the light reflecting sheet being superimposed on the base sheet, and a light diffusing sheet having a light refracting surface, the light refracting surface transmitting light and refracting the transmitted light in multiple directions, and the light diffusing sheet being superimposed on the light reflecting sheet, wherein each of the light reflecting sheet and the light diffusing sheet have an opening passing therethrough at a location where a symbol is to be arranged.

15. The gaming machine according to claim 14 further comprising, a backlight for illuminating the reels from inside, and the base sheet has a light transmission property, and is configured to transmit light emitted from the backlight and allow the light to be emitted through the opening.

16. The gaming machine of claim 15, wherein the reel band further comprises a light dimming sheet configured to modulate the intensity of light emitted from the backlight.

17. The gaming machine of claim 16, wherein the light dimming sheet is positioned between a pair of base sheets each having a symbol including a color that is different from the other.

18. The gaming machine of claim 17, wherein the reel band comprises at least three base sheets, each base sheet having a symbol including a color that is different from the other.

* * * * *